US012704348B2

(12) United States Patent
Munsell et al.

(10) Patent No.: US 12,704,348 B2
(45) Date of Patent: Aug. 11, 2026

(54) ARROW REST DEVICE

(71) Applicant: HAMSKEA ARCHERY SOLUTIONS LLC, Frederick, CO (US)

(72) Inventors: Andrew W. Munsell, Brighton, CO (US); Devin Hall, Ft. Collins, CO (US); John Vitera, Firestone, CO (US)

(73) Assignee: Hamskea Archery Solutions LLC, Frederick, CO (US)

( * ) Notice: Subject to any disclaimer, the term of this patent is extended or adjusted under 35 U.S.C. 154(b) by 0 days.

(21) Appl. No.: 17/806,011

(22) Filed: Jun. 8, 2022

(65) Prior Publication Data

US 2022/0397370 A1 Dec. 15, 2022

Related U.S. Application Data

(60) Provisional application No. 63/262,359, filed on Oct. 11, 2021, provisional application No. 63/202,397, filed on Jun. 9, 2021.

(51) Int. Cl.
*F41B 5/14* (2006.01)

(52) U.S. Cl.
CPC ..... *F41B 5/143* (2013.01)

(58) Field of Classification Search
CPC ..... F41B 5/143; F41B 5/066; F41B 5/148; F41G 1/467; F41G 11/003; F41G 11/004; F41C 27/00; F41C 33/04
See application file for complete search history.

(56) References Cited

U.S. PATENT DOCUMENTS 572,291 A * 12/1896 Crawford ..... F16B 21/12 411/355
2,914,857 A * 12/1959 Perwas ..... G01B 3/303 33/838
2,947,301 A 8/1960 Haulk
2,975,780 A 3/1961 Fisher
3,163,938 A * 1/1965 Reynolds ..... F41G 1/467 33/265
3,318,298 A 5/1967 Bear
3,377,999 A 4/1968 Reynolds
3,410,644 A 11/1968 Mclendon
(Continued)

OTHER PUBLICATIONS

Office Action issued in co-owned, U.S. Appl. No. 17/806,147 dated Aug. 17, 2022, and the references cited and relied on by the Examiner therein.

(Continued)

*Primary Examiner* — John E Simms, Jr.
*Assistant Examiner* — Amir A Klayman
(74) *Attorney, Agent, or Firm* — Trenner Law Firm, LLC; Mark Trenner

(57) ABSTRACT

An arrow rest device is disclosed. The example arrow rest device includes a geometrically shaped mounting bracket. The example arrow rest device also includes a coupler for connecting to the geometrically shaped mounting bracket. The example arrow rest device also includes a base of the coupler, the base having a parallel clamp with two components. The example arrow rest device also includes a plank member that is perpendicular to the base. The example arrow rest device also includes a coupling mechanism that positions the coupler relative to the geometrically shaped mounting bracket.

16 Claims, 44 Drawing Sheets

(56) References Cited

U.S. PATENT DOCUMENTS 3,504,659 A 4/1970 Babington
3,559,940 A * 2/1971 Kruzell ..... F41G 11/001 248/223.41
3,574,944 A * 4/1971 Reynolds ..... F41G 1/467 33/265
3,802,411 A 4/1974 Manspeaker
4,005,696 A 2/1977 Jennings
4,079,722 A 3/1978 Griggs
4,127,943 A * 12/1978 Tiritilli ..... F41G 1/28 42/138
4,287,868 A 9/1981 Schiff
4,368,581 A 1/1983 Tullos
4,372,285 A 2/1983 Victor
4,407,261 A 10/1983 Elliott
4,453,528 A 6/1984 Eckert
4,476,846 A 10/1984 Carville
4,535,747 A * 8/1985 Kudlacek ..... F41G 1/467 124/87
4,584,777 A 4/1986 Saunders
4,625,421 A * 12/1986 Strauss ..... F41G 1/467 33/265
4,664,093 A 5/1987 Nunemaker
4,686,956 A 8/1987 Fernando, Jr.
4,742,636 A * 5/1988 Swan ..... F41G 11/006 42/126
4,803,971 A 2/1989 Fletcher
4,827,895 A 5/1989 Fernando, Jr.
4,899,716 A 2/1990 Martin et al.
4,919,115 A 4/1990 Miller
4,959,908 A * 10/1990 Weyrauch ..... F41G 11/003 42/127
5,022,378 A 6/1991 Rhodehouse et al.
5,052,364 A 10/1991 Martin et al.
5,062,407 A 11/1991 Newbold
5,085,201 A 2/1992 Tepper
5,086,566 A * 2/1992 Klumpp ..... F41G 11/003 42/126
5,095,884 A * 3/1992 Mertens ..... F41B 5/1438 124/44.5
5,103,797 A 4/1992 Newbold
5,117,803 A * 6/1992 Johnson ..... F41B 5/143 124/44.5
5,140,972 A 8/1992 Fisk
5,144,752 A * 9/1992 Boeke ..... F41G 11/001 42/126
5,285,764 A 2/1994 Mertens
5,341,791 A 8/1994 Shafer
5,365,912 A 11/1994 Pittman
5,372,119 A * 12/1994 Kidney ..... F41B 5/143 124/44.5
5,379,746 A 1/1995 Sappington
5,383,441 A 1/1995 Lightcap
5,386,814 A 2/1995 Denton
5,394,858 A 3/1995 Laliberte
5,429,107 A 7/1995 Troncoso, Jr.
5,447,284 A * 9/1995 Heinz ..... F41B 5/143 124/44.5
5,476,086 A 12/1995 Smith
5,490,491 A 2/1996 Troncoso
5,507,272 A 4/1996 Scantlen
5,529,049 A * 6/1996 Antalosky ..... F41B 5/1438 124/44.5
5,533,494 A * 7/1996 Sacco ..... F41B 5/143 124/44.5
5,553,597 A 9/1996 Sparks
5,606,962 A 3/1997 Troncoso
5,632,263 A 5/1997 Sartain
5,678,530 A 10/1997 Van Drielen
5,697,356 A 12/1997 Chappell
5,720,270 A * 2/1998 Meicke ..... F41G 1/467 42/137
5,722,381 A 3/1998 Mizek
RE36,266 E 8/1999 Gibbs
5,960,779 A 10/1999 Jessee
6,000,141 A * 12/1999 Afshari ..... F41G 1/467 33/265
6,044,832 A 4/2000 Piersons, Jr.
6,050,251 A 4/2000 Harwath
6,089,216 A 7/2000 Harwath et al.
6,178,959 B1 1/2001 Troncoso, Jr. et al.
6,202,635 B1 3/2001 Evans
6,334,349 B1 1/2002 Rolf
6,363,924 B1 4/2002 Adams, Jr.
6,430,822 B1 * 8/2002 Slates ..... F41G 1/467 124/87
6,477,778 B1 11/2002 Lorocco
6,561,174 B1 5/2003 Afshari
6,591,823 B1 7/2003 Keller
6,595,195 B1 7/2003 Barner et al.
6,615,813 B1 9/2003 Troncoso, Jr. et al.
6,644,297 B1 11/2003 Brown
6,648,287 B2 11/2003 Wooten et al.
6,732,395 B2 5/2004 Gringer
6,739,321 B1 5/2004 Puchlerz
6,772,747 B1 8/2004 Vastag
6,782,881 B2 8/2004 Mizek et al.
6,789,535 B1 * 9/2004 McIntyre ..... F41B 5/143 124/44.5
6,789,536 B1 9/2004 Summers
6,802,129 B1 10/2004 Wirth
6,895,676 B1 * 5/2005 Mendyk ..... F41G 1/467 124/87
6,913,008 B2 7/2005 Simo et al.
6,915,791 B2 7/2005 Harwath et al.
6,922,900 B1 8/2005 Henry
7,100,591 B2 9/2006 Terry
7,219,662 B1 5/2007 Henry
7,331,338 B2 2/2008 Mizek et al.
7,409,950 B2 8/2008 Ellig et al.
7,444,776 B2 * 11/2008 Adams ..... F41G 11/001 42/127
7,574,810 B1 * 8/2009 LoRocco ..... F41G 1/44 124/87
7,574,811 B2 * 8/2009 Kurtzhals ..... F41G 1/467 124/87
7,597,095 B2 10/2009 Grace, Jr. et al.
7,634,990 B1 12/2009 Gartland
7,681,566 B2 3/2010 Mertens
7,717,103 B2 5/2010 Johnson
7,748,371 B1 7/2010 Doty
7,913,678 B2 3/2011 Hudkins
7,971,384 B2 * 7/2011 Lippard ..... F41G 11/007 42/127
7,975,391 B1 7/2011 Munsell et al.
7,980,237 B1 7/2011 Rasor et al.
8,196,329 B1 6/2012 Mossie
8,333,180 B2 12/2012 Mizek
8,342,161 B2 1/2013 Harwath et al.
8,397,421 B2 3/2013 Ding et al.
8,407,924 B2 * 4/2013 Lee ..... F41G 1/473 42/111
8,434,464 B1 5/2013 Terzo
8,474,443 B2 7/2013 Geno
8,544,457 B1 10/2013 Munsell et al.
8,567,382 B2 10/2013 Kingsbury et al.
8,752,536 B2 6/2014 Sims
8,820,690 B2 * 9/2014 Weber ..... F16M 13/022 248/231.71
8,826,896 B1 9/2014 McPherson
8,839,525 B2 * 9/2014 Pulkrabek ..... F41G 1/467 124/87
8,875,687 B1 11/2014 Huang
RE45,330 E 1/2015 Kempf
8,939,137 B2 1/2015 Hunt
8,960,174 B2 2/2015 Khoshnood
9,004,054 B2 4/2015 Khoshnood
9,151,567 B1 10/2015 Estridge
9,182,190 B2 11/2015 Khoshnood
9,341,433 B1 5/2016 Summers
9,506,726 B2 11/2016 Wolf
9,651,330 B1 5/2017 LoRocco et al.

(56) References Cited

U.S. PATENT DOCUMENTS

| | | | | |
|---|---|---|---|---|
| 9,726,453 | B1 | 8/2017 | Hamm et al. | |
| 9,746,277 | B2 | 8/2017 | Khoshnood | |
| 9,816,776 | B2 | 11/2017 | Ellig et al. | |
| 9,829,270 | B2 | 11/2017 | Summers | |
| 9,933,229 | B2 | 4/2018 | Coalson et al. | |
| 10,012,473 | B2 | 7/2018 | Munsell et al. | |
| 10,077,964 | B2 | 9/2018 | Summers | |
| 10,088,264 | B2 * | 10/2018 | Summers | F41B 5/143 |
| 10,295,296 | B2 | 5/2019 | Summers | |
| 10,330,424 | B2 | 6/2019 | Brown | |
| 10,415,924 | B1 * | 9/2019 | Huang | F41G 1/38 |
| 10,514,228 | B2 | 12/2019 | Summers et al. | |
| 10,539,390 | B2 | 1/2020 | Summers et al. | |
| 10,634,448 | B2 | 4/2020 | Brown | |
| 10,746,498 | B2 | 8/2020 | Garretson | |
| 10,746,499 | B2 | 8/2020 | Munsell et al. | |
| 10,852,097 | B2 | 12/2020 | Wilson et al. | |
| 10,859,339 | B2 | 12/2020 | Summers et al. | |
| 10,907,933 | B1 | 2/2021 | Summers | |
| 11,098,974 | B2 | 8/2021 | Summers et al. | |
| 11,105,579 | B2 | 8/2021 | Summers et al. | |
| 11,105,581 | B2 | 8/2021 | Summers et al. | |
| 11,359,884 | B2 | 6/2022 | Summers et al. | |
| 11,385,033 | B2 | 7/2022 | Langdon | |
| 11,415,392 | B2 | 8/2022 | Munsell | |
| 11,578,946 | B1 * | 2/2023 | Wan | F41G 1/35 |
| 2003/0062033 | A1 * | 4/2003 | Martin | F41B 5/14 403/230 |
| 2006/0157038 | A1 | 7/2006 | Ellig et al. | |
| 2008/0236556 | A1 | 10/2008 | Sims | |
| 2010/0181454 | A1 * | 7/2010 | Vogt | F16M 11/041 248/309.1 |
| 2013/0174430 | A1 * | 7/2013 | Pulkrabek | F41G 1/467 33/228 |
| 2015/0013207 | A1 | 1/2015 | Bowman | |
| 2015/0184972 | A1 | 7/2015 | Grace et al. | |
| 2017/0191788 | A1 | 7/2017 | Eacker | |
| 2019/0390937 | A1 | 12/2019 | Mason | |
| 2020/0132410 | A1 | 4/2020 | Summers et al. | |
| 2020/0149838 | A1 * | 5/2020 | Summers | F41B 5/14 |
| 2020/0378714 | A1 | 12/2020 | Fisher et al. | |
| 2021/0254923 | A1 | 8/2021 | Summers et al. | |
| 2021/0404764 | A1 | 12/2021 | Summers et al. | |
| 2022/0113108 | A1 | 4/2022 | Munsell | |
| 2022/0325978 | A1 | 10/2022 | Hall et al. | |
| 2022/0397370 | A1 | 12/2022 | Munsell et al. | |
| 2022/0412688 | A1 * | 12/2022 | Fisher | F41B 5/143 |
| 2023/0272995 | A1 * | 8/2023 | Munsell | F41B 5/143 124/41.1 |

OTHER PUBLICATIONS

"Shrewd Remedy arrow Rest", available at https://www.shrewdarchery.com/collections/arrow-rest/products/remedy-arrow-rest, May 14, 2017.

"DS Archery Arrow Rest", available at https://www.archerytalk.com/threads/ds-advantage-target-rest-with-extras.2159614/#post-1069071071, 2014.

"Kodiak Archery Bow Logic Compound bow models 32 and 34", available at https:forums.realtree.comtopic57423-kodiak-outdoors-bow-logic-36, 2004.

Original Pro V available on the Internet at https://www.vaportrailarchery.com/pro-v-arrow-rest-vapor-trail.html, screen capture Apr. 3, 2023.

Trophy Taker Smackdown Pro Fall Away Arrow Rest available on the Internet at https://www.cabelas.com/shop/en/trophy-taker-smackdown-pro-fall-away-arrow-rest?ds_e=MICROSOFT&ds_c=Cabelas%7CShopping%7CSmart%7CCatchAll%7CGeneral%7CNAud%7CNVol% 7CNMT&&&&&msclkid=385bb65064001e80a0f9d270160a81f4&gclid=385bb65064001e80a0f9d270160a81f4&gclsrc=3p.d, screen capture Apr. 3, 2023.

Quality Archery Designs "Ultrarest® TRI™" accessed from https://qadinc.com/product/ultrarest-tri/ on Feb. 16, 2026 but product available prior to Applicant's Priority Filing Date (3 pages).

Lancaster Archery Supply "How to Install the Mathews QAD Integrate TRi Premium Rest | Unboxing". Youtube screenshot accessed from https://www.youtube.com/watch?v=2Xy-EASJN21&t=1s on Feb. 16, 2026 but video posted "5 years ago" ~2021 (1 page).

Archery Manufacturers Organization "Standards" 1987 (12 pages).

"Hoyt Powermax Compound Bow, Epsilon, Trophy Ridge, Custom 60-70lb 25.5-30" Draw accessed at URL https://www.ebay.com/itm/257062616785?_skw=hoyt+stider&itmmeta=01KHH7A3CD52KY9AGB9KPENV72&hash=item3bda203ed1 on Feb. 16, 2025, but product available prior to Applicant's Priority Filing Date, believed to be as early as 1997 (3 pages).

"Hoyt dovetail integrated dovetail sight mount, circa 1997" (2 pages).

"CBE X4 Arrow Rest, Black, One Size," Amazon, accessed from URL https://www.amazon.com/dp/B07T471D44 on Feb. 16, 2026 but product available prior to Applicant's Priority Filing Date (8 pages).

* cited by examiner

ARROW REST DEVICE

PRIORITY CLAIM

This application claims the priority filing benefit of U.S. Provisional Patent Application No. 63/262,359 filed Oct. 11, 2021 for "Arrow Rest Device" of Devin Hall, and U.S. Provisional Patent Application No. 63/202,397 filed Jun. 9, 2021 for "Arrow Rest Device" of Andrew W. Munsell, Devin Hall, and John Vitera, each hereby incorporated by reference in its entirety as though fully set forth herein.

BACKGROUND

The archery industry has been standardized on interfaces for mounting accessories to a bow riser as described by the Archery Manufacturer's Organization (AMO) standards. Threaded holes of varying sizes on vertical surfaces of a bow riser enable sighting devices, arrow rest, quivers and stabilizers alike to be mounted to the bow riser in a variety of orientations. In the case of the arrow rest, archery sight and quivers, these standard holes are located on the outward vertical plane of the bow riser which are orthogonal to the plane of the down range target when the bow is aimed at the target. This places the accessory laterally some distance away from the center line and center of gravity (CoG) of the bow assembly. This approach for mounting accessories laterally from the centerline or center gravity of the bow generates an undesired imbalance. Throughout the history of modern archery, many instantiations of accessories have been mounted to the forward and aft vertical surfaces of a bow riser in the pursuit of achieving optimum balance and stability. Certain types of accessories (e.g. arrow rest and sights) are extremely sensitive to small changes in position and the associated impact on accuracy. Having the ability to micro-adjust these accessories and to interchange elements of each allows the user to optimize the balance of their shooting system.

BRIEF DESCRIPTION OF THE DRAWINGS

FIG. 27 illustrates the features of the microtune peg/protrusion.

DETAILED DESCRIPTION

Figure 1:
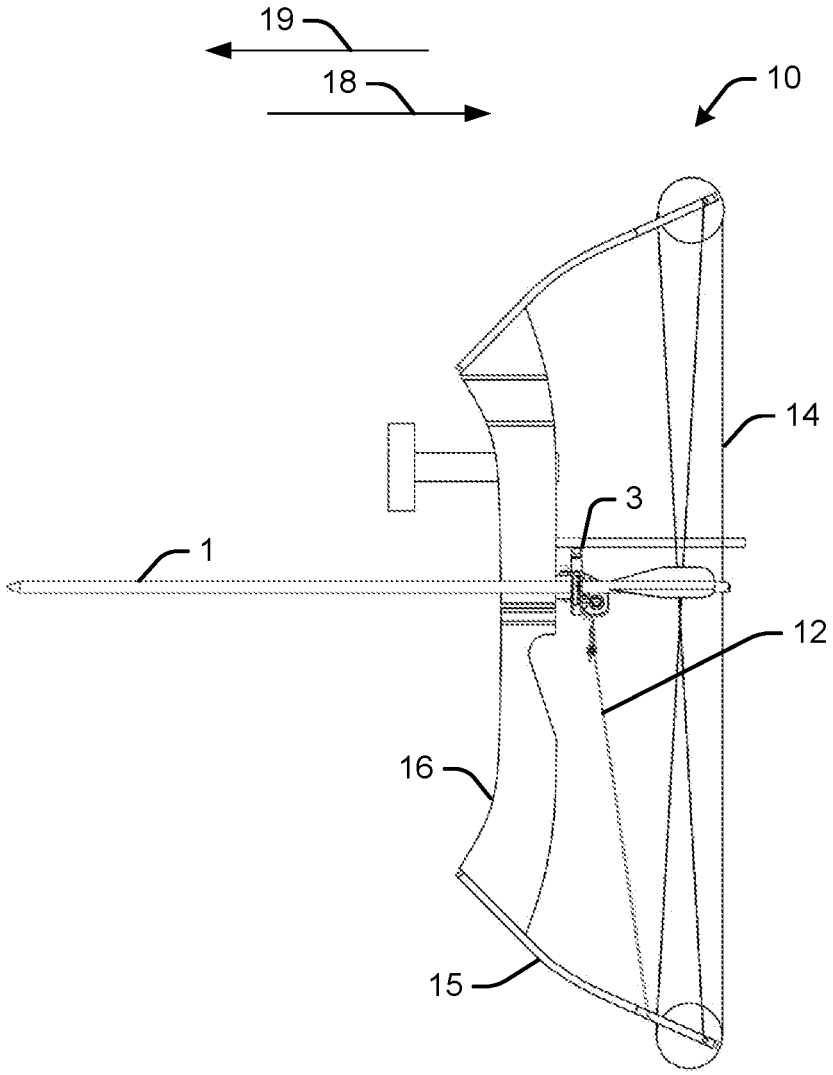
FIG. 1 is an example limb actuated configuration archery bow system, shown at rest with the cord under tension, bow system at rest.

An arrow rest device is disclosed that is mountable to a geometrically shape mounting bracket that vertically aligned to an aft facing (closest to the archer) vertical plane of a bow riser when the bow is held for aiming at a target.

An arrow rest device is disclosed. In an example, a mounting bracket is mounted to an aft facing vertical plane of a bow riser when the bow is held for aiming at a target. The example arrow rest device includes a geometrically shaped mounting bracket. The example arrow rest device may also include a coupler mount for connecting to the geometrically shaped mounting bracket. The example arrow rest device may also include a base of the coupler mount, the base having a parallel clamp with two components and an integral positioning mechanism with movable coupling protrusion that does not require disassembly to be coupled to the geometrically shaped mounting bracket. Where the clamping force inserts the coupling mechanism protrusion between the two components, thereby coupling them together. The example arrow rest device may also include a plank member that is perpendicular to the base for lateral mounting of an intermediate block that allows the accessory to be positioned forward. This lateral mounting configuration also enables the accessory to be interchangeable with another accessory configured for different arrow configuration for the same bow system.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

An example arrow rest device includes several components that all work together to provide the following functions. Provide the ability to mount an arrow rest to any shape assumed as part of the aft portion of an archery bow riser, where "aft" is defined to be any surface whose normal vector has a scalar value that is substantially parallel to the line of sight to the target. Support an arrow prior to and through the launching of the arrow. Provide arrow stabilizing devices (e.g., fletchings, vanes, other) clearance for no interference between any element of the arrow rest and the arrow and its components. Provide the ability to adjust the rest relative to the polygon shaped mount to optimize the arrow rest position relative to the optimum launch position of the arrow, relative to the geometric attributes of the archery bow system in the, a) lateral (L-R, R-L), b) vertical (up-down, down-up), c) forward (toward the target), d) aft (toward the archer). Provide the ability to reconfigure the arrow rest assembly to optimum arrow position by exchanging a portion of the arrow rest assembly to accommodate the difference of arrow characteristics (e.g., diameter, spine or stiffness, length). Provide a physical boundary from which the arrow is located within the functional proximity of the arrow rest (also referred to as a containment bracket). Provides the ability for quick interchangeability between any two arrow rest assemblies configured for different arrow types to be used on the same bow system.

Figure 2:
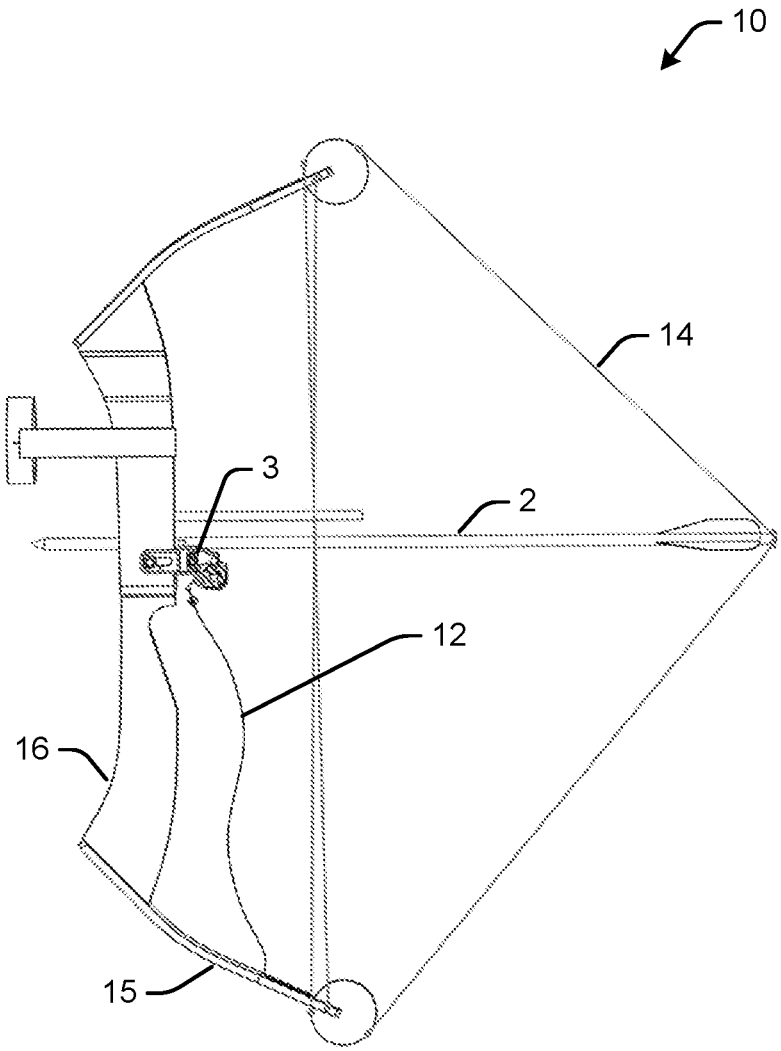
FIG. 2 is an example archery bow system of FIG. 1 drawn back into shooting position, cord not under tension.

FIG. 1 is an example limb actuated configuration archery bow system 10, shown at rest with the rest activation cord 12 under tension when the drawstring 14 is relaxed. FIG. 2 is an example archery bow system 10 of FIG. 1, shown with the drawstring 14 at full draw and the rest activation cord 12 released from tension.

An example archery bow system 10 includes a bow limb 15 and bow riser 16. The bow riser 16 may be provided in many shapes and thicknesses to accommodate aesthetics, structural integrity and the function of mounting accessories. The aft end surface(s) of the bow riser 16 (aft direction illustrated by arrow 18; forward direction 19 illustrated by arrow 1) can be any number of shapes. By way of illustration, shapes may include but are not limited to flat and vertical/straight, flat and curved (e.g., not vertical or straight), compound (curved or beveled) and vertical/straight or compound and curved. The ability to adjust an arrow rest 3 and launcher 89 purely in the vertical plane is critical to optimizing the location and tune of the bow system 10 relative to launching an arrow 1.

Figure 3:
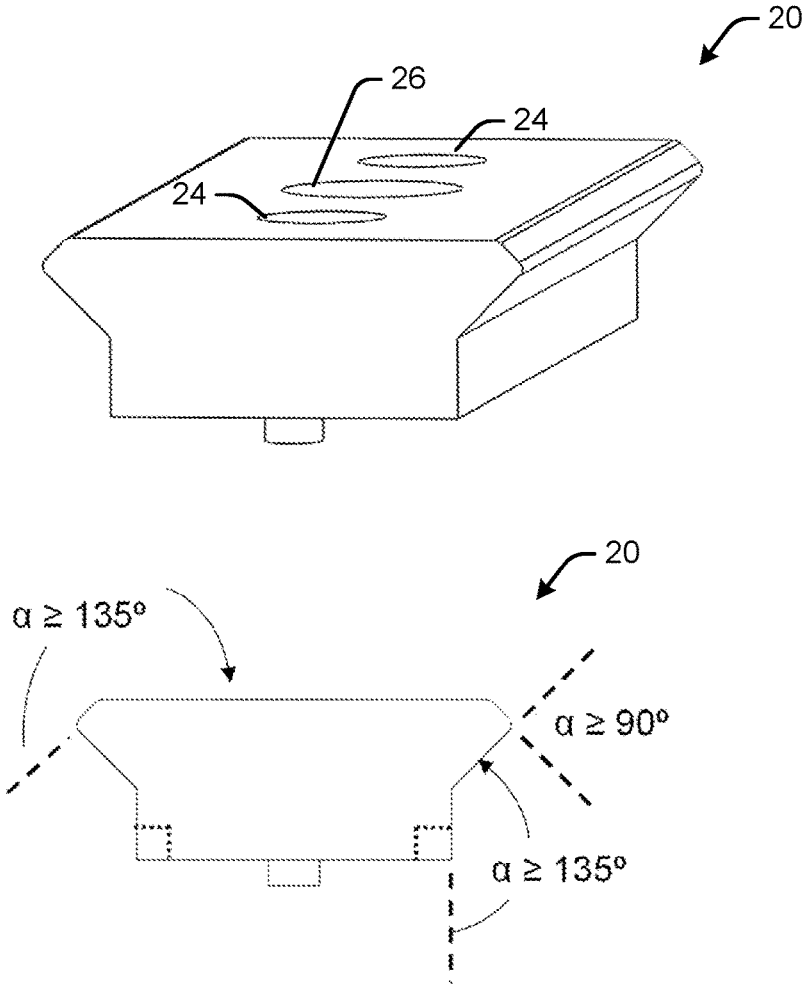
FIG. 3 is an isometric view and corresponding side view of an example mounting bracket.

FIG. 3 is an isometric view and corresponding side view of an example geometrically (polygon, circular) shaped mount 20. The mount 20 has a polygon shape. Polygon shaped brackets may be provided for mounting accessories to a flat surface of the arrow rest 3.

Figure 4:
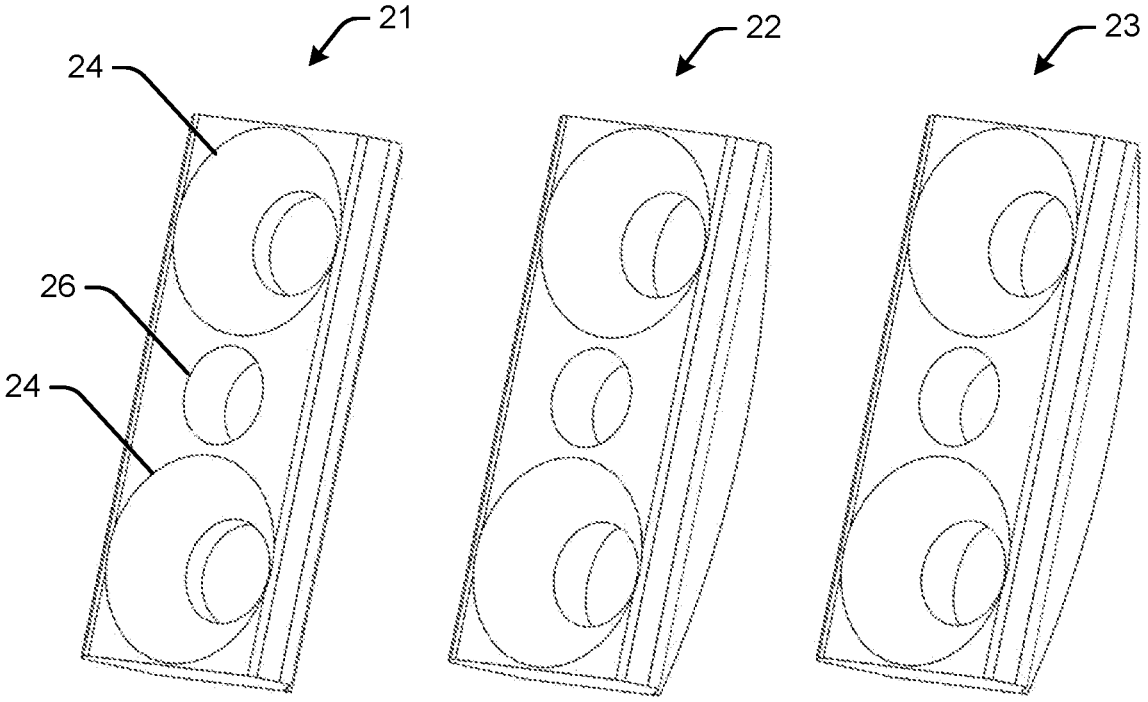
FIG. 4 shows front isometric views of example mounting brackets.
Figure 5:
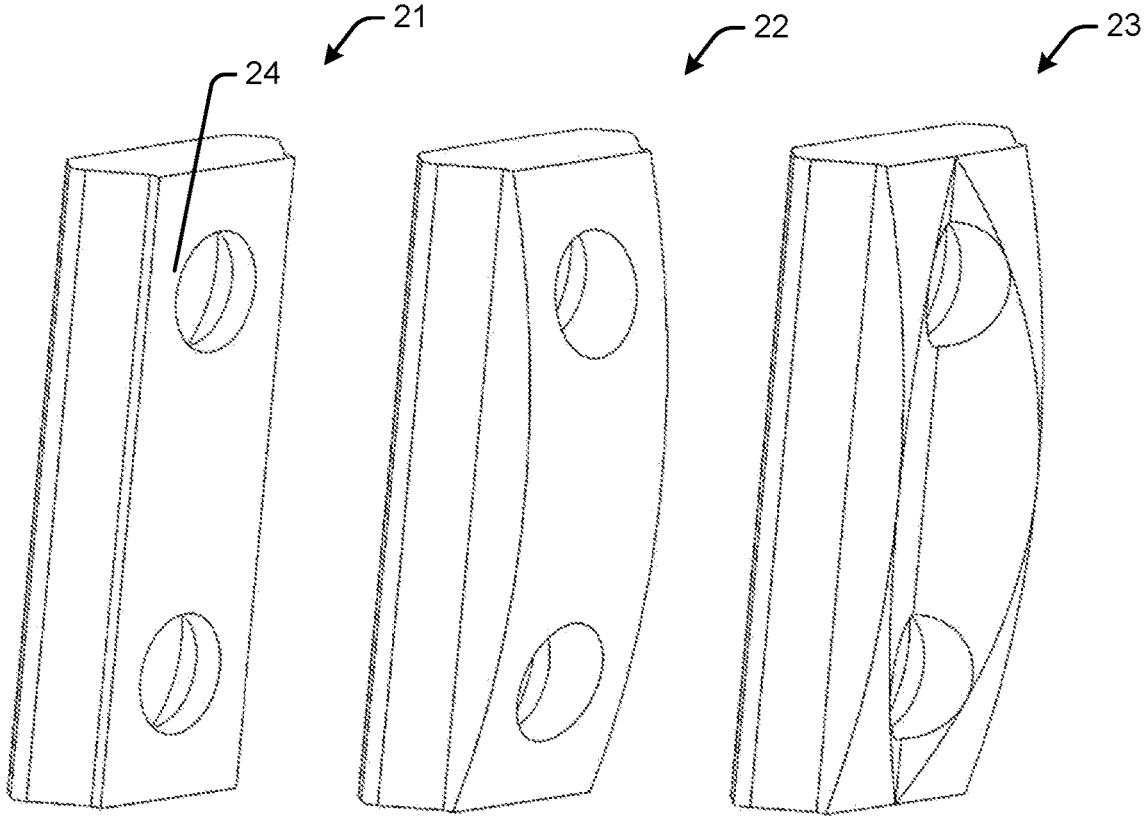
FIG. 5 shows rear isometric views of example mounting brackets.

Even in the event that the bow riser 16 aft surface 18 is not vertical and flat, the mounting bracket 20 disclosed herein provides such an interface. The mounting bracket may have any suitable shape. See FIGS. 4 and 5 for purposes of illustration. FIG. 4 shows front isometric views of example mounting brackets 21, 22, and 23. FIG. 5 shows rear isometric views of the example mounting brackets 21, 22, and 23.

The geometrically shaped mount (hereinafter generally referred to as the mounting bracket 20) may include a microtune peg receiving feature 26 discussed in more detail below. The mounting bracket 20 may also include mounting through-holes 24 for attaching the mounting bracket 20 to the bow riser 16.

Figure 6:
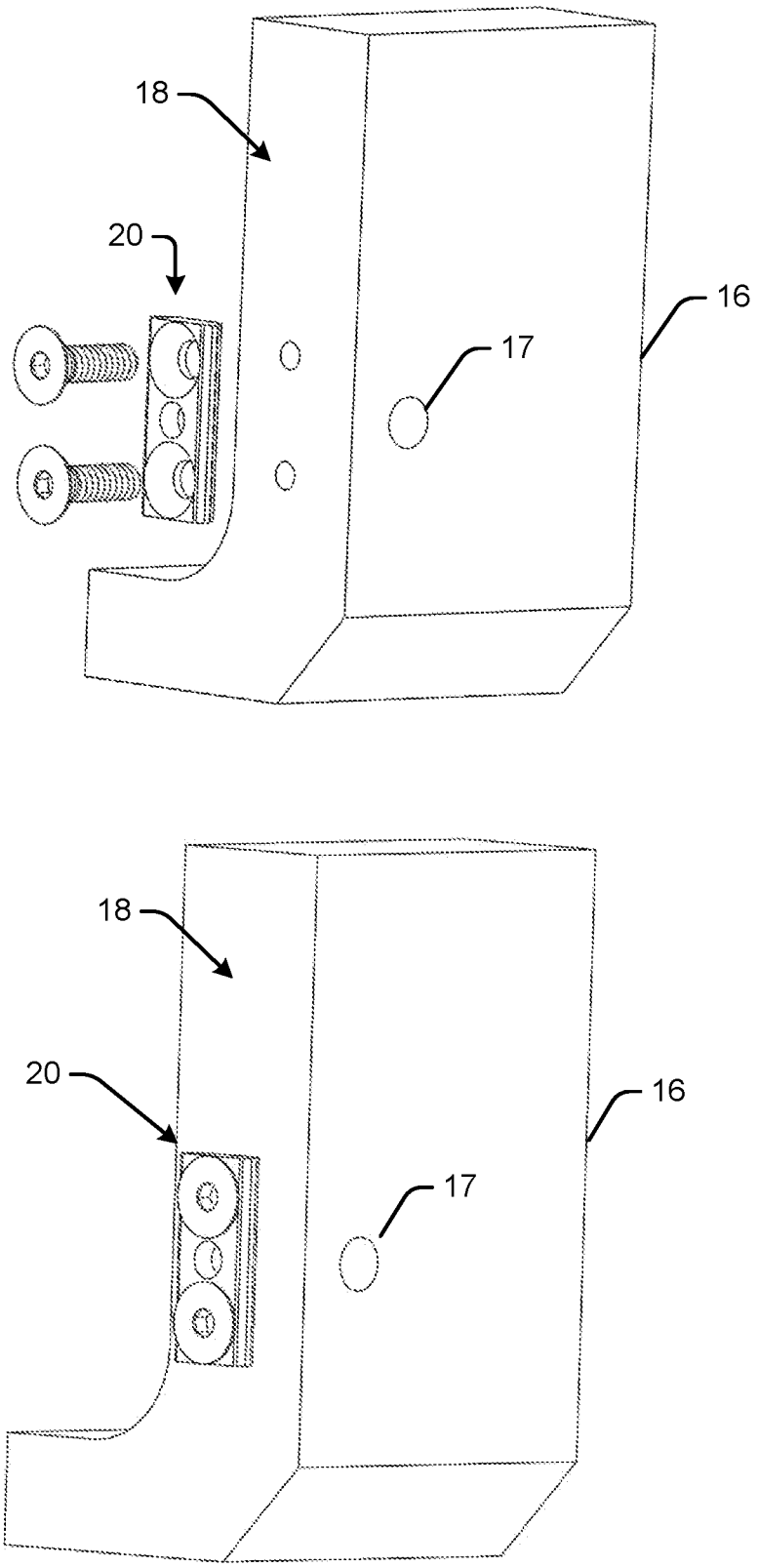
FIG. 6 shows an example polygon shaped mount, both attached and unattached to a bow riser.
Figure 7:
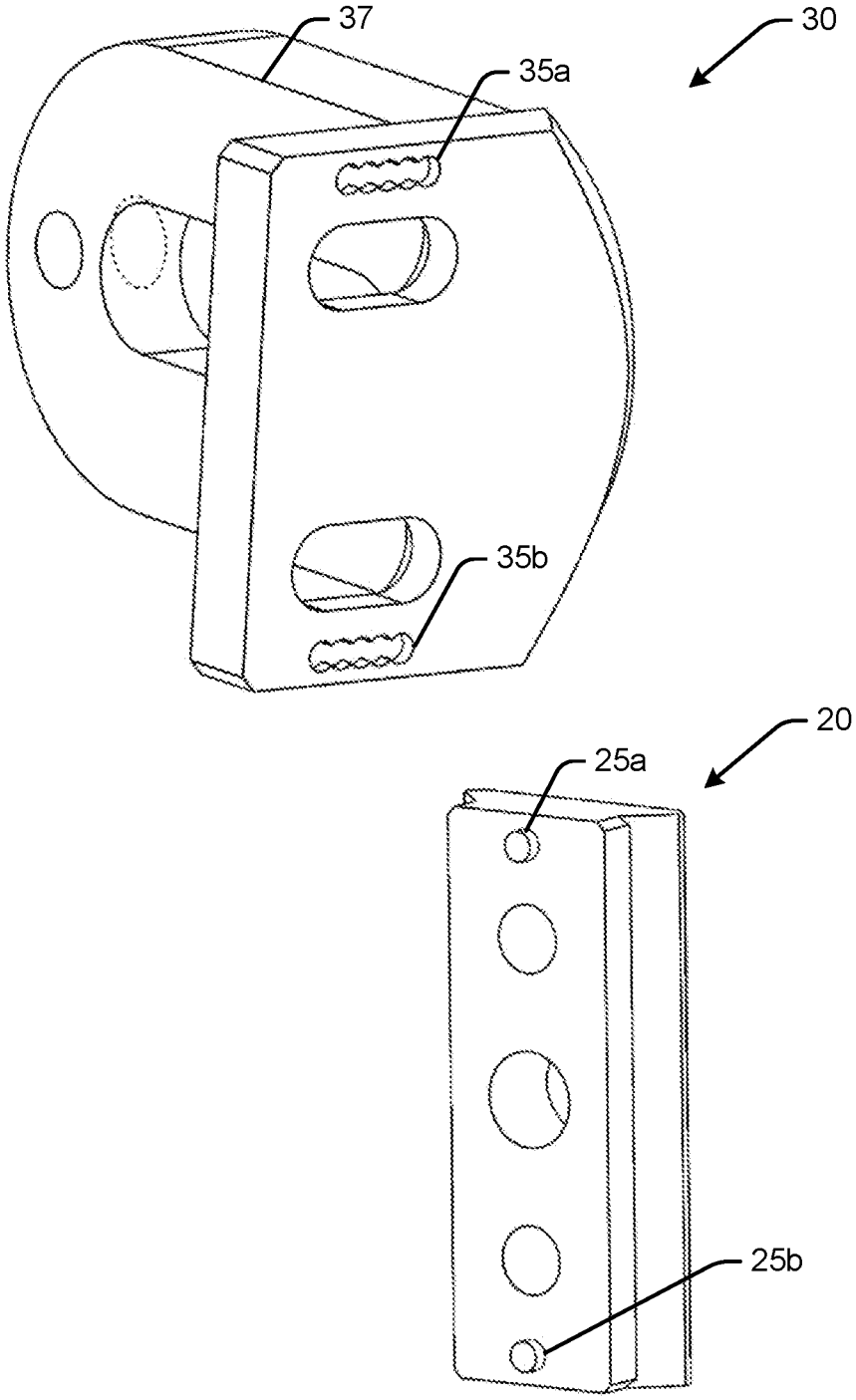
FIGS. 7-10 are perspective views of an example mounting bracket with polygon shaped mount.
Figure 8:
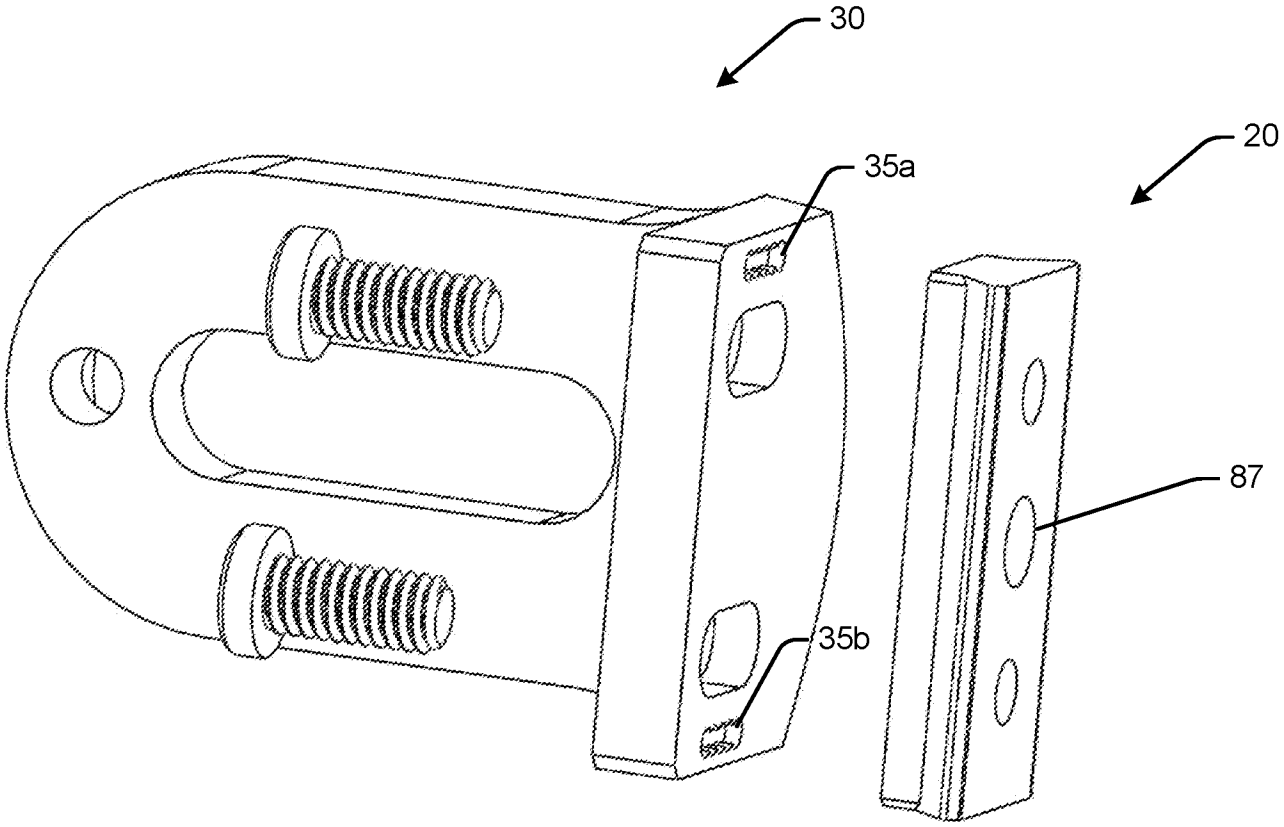
Figure 9:
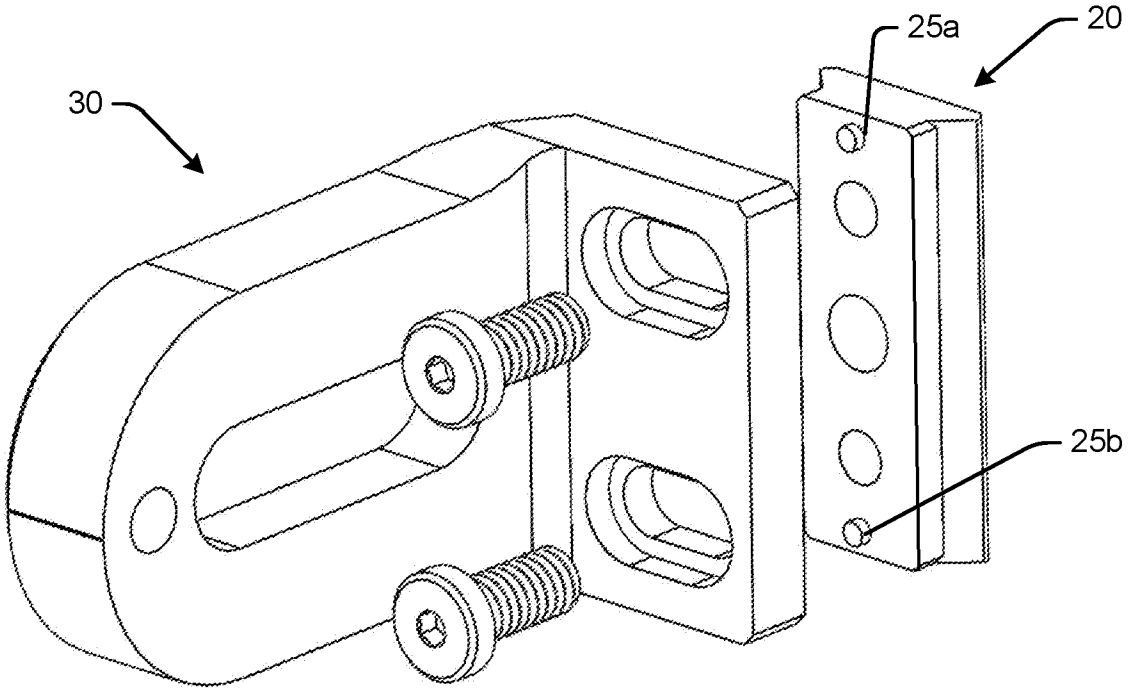
Figure 10:
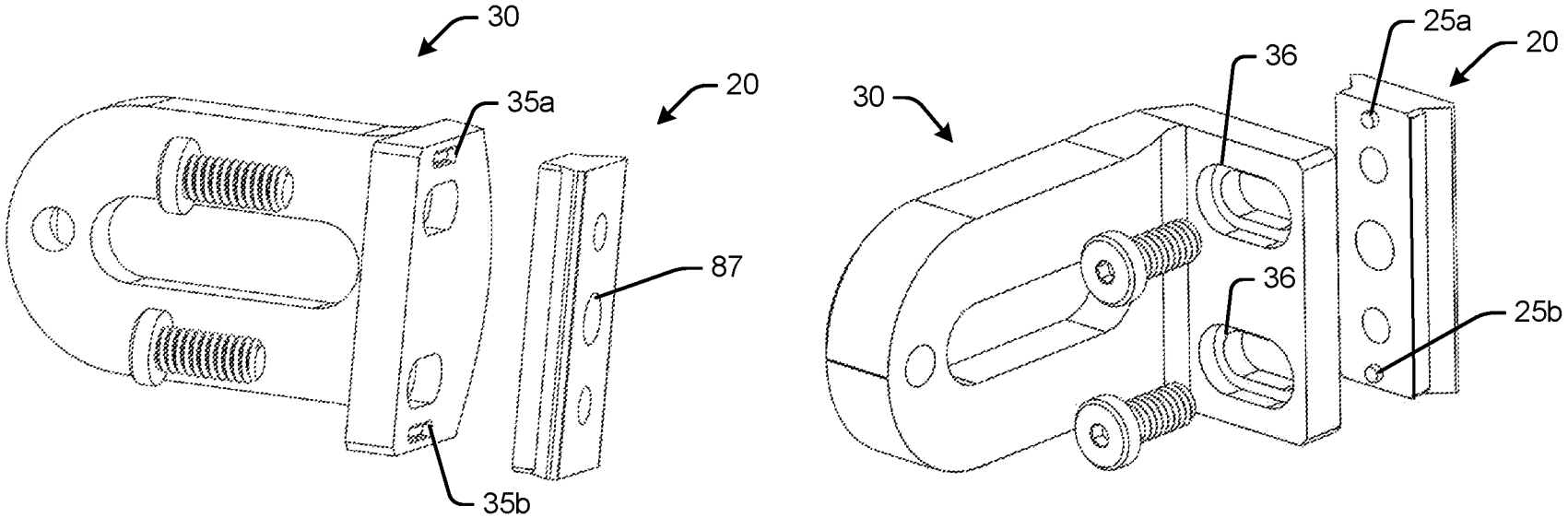

The mounting bracket 20 may be mounted to a bow riser 16 of the archery bow system 10. FIG. 6 shows an example mounting bracket 20 both in an unattached configuration, and in a configuration wherein the mounting bracket 20 is attached to a bow riser 16.

FIGS. 7-10 are perspective views of an example mounting bracket 20 with riser mount 30. In an example, the riser mount 30 has a surface 37 referenced to the outward bow riser vertical plane. The riser mount 30 may also include at least one receiving positioning feature (e.g., vertical pairs 35*a*, 35*b*). The receiving positioning feature(s) 35*a*, 35*b* are configured to receive mating alignment features 25*a*, 25*b* in the mounting bracket 20. The example mounting bracket 20 may be fine adjusted by moving the feature(s) 35*a*, 35*b* of the coupler mount 30 relative to the features 25*a*, 25*b* in the mounting bracket 20.

The geometrically shaped mount 20 can be attached to any surface of the bow riser. Where a surface can be (but is not limited to) forward, aft, left, right vertical, horizontal, top, bottom, or any surface that has a normal vector that includes one of the directions.

Figure 11:
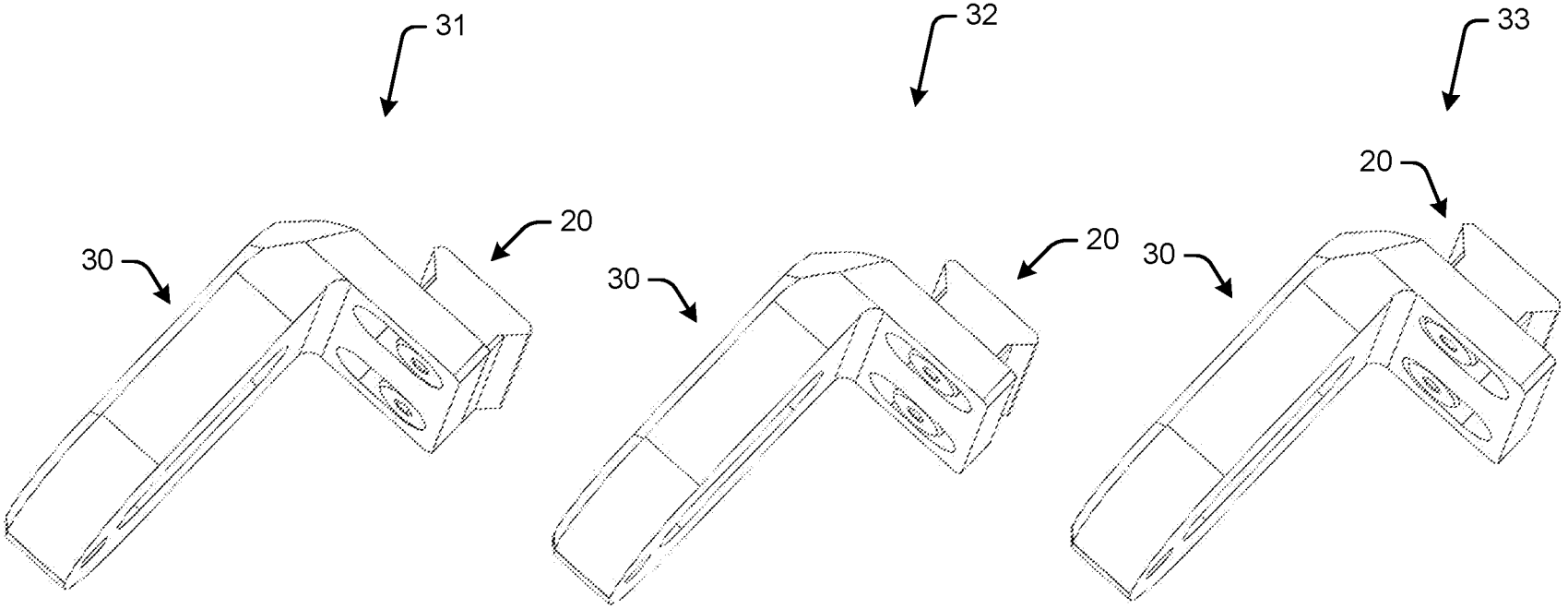
FIG. 11 are different top perspective views of the example mounting bracket attached to the coupler mount illustrating various adjustments.

FIG. 11 are different top perspective views of the example mounting bracket 20 attached to the riser mount 30 illustrating various adjustments 31, 32, and 33. The adjustment 31 shows the polygon shaped mount position for a bow riser width of about 0.800" to about 0.910". The adjustment 32 shows the dovetail mount position for a bow riser width of about 0.700" to about 0.800". The adjustment 33 shows the dovetail mount position for a bow riser width of about 0.600" to about 0.700".

The polygon shaped mount when mounted to the aft surface of the bow riser can be precisely located for a predetermined distance from the vertical lateral surface of the inner-bow riser plane known as the center-shot distance which is usually between 13/16" to 7/8". The center of the arrow rest assembly (i.e. center of "V" of the arrow launcher 89) can be precisely achieved by locating the mounting holes for the geometrically shaped mount 20 at a prescribed distance (between 0.25" and 0.600") from the datum surface being the inner-bow riser vertical surface (Datum A) also known as the sight window.

Figure 12:
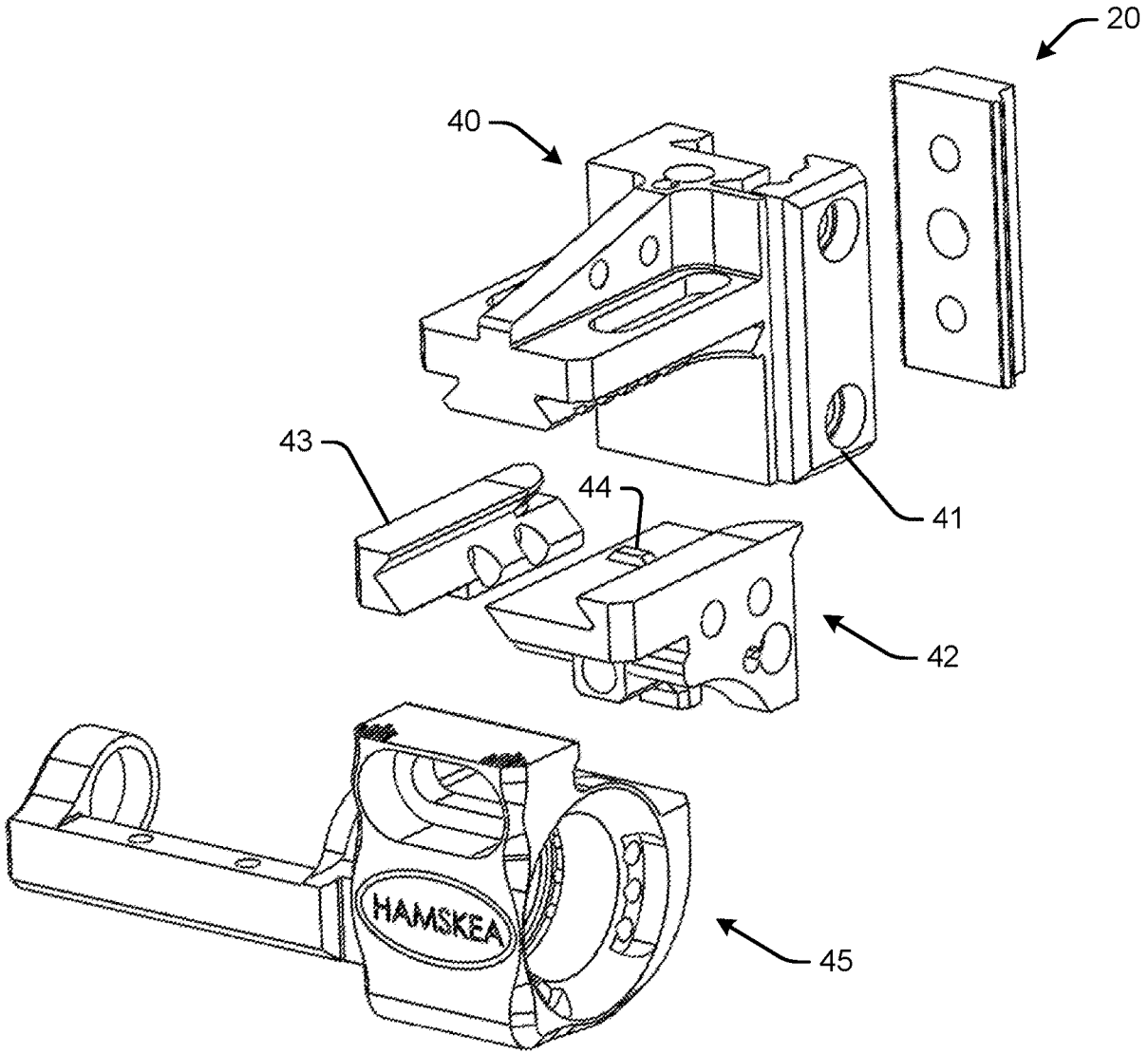
FIGS. 12 and 13 are perspective views of the example polygon shaped mount and a T-shaped coupler having a separate clamp.
Figure 13:
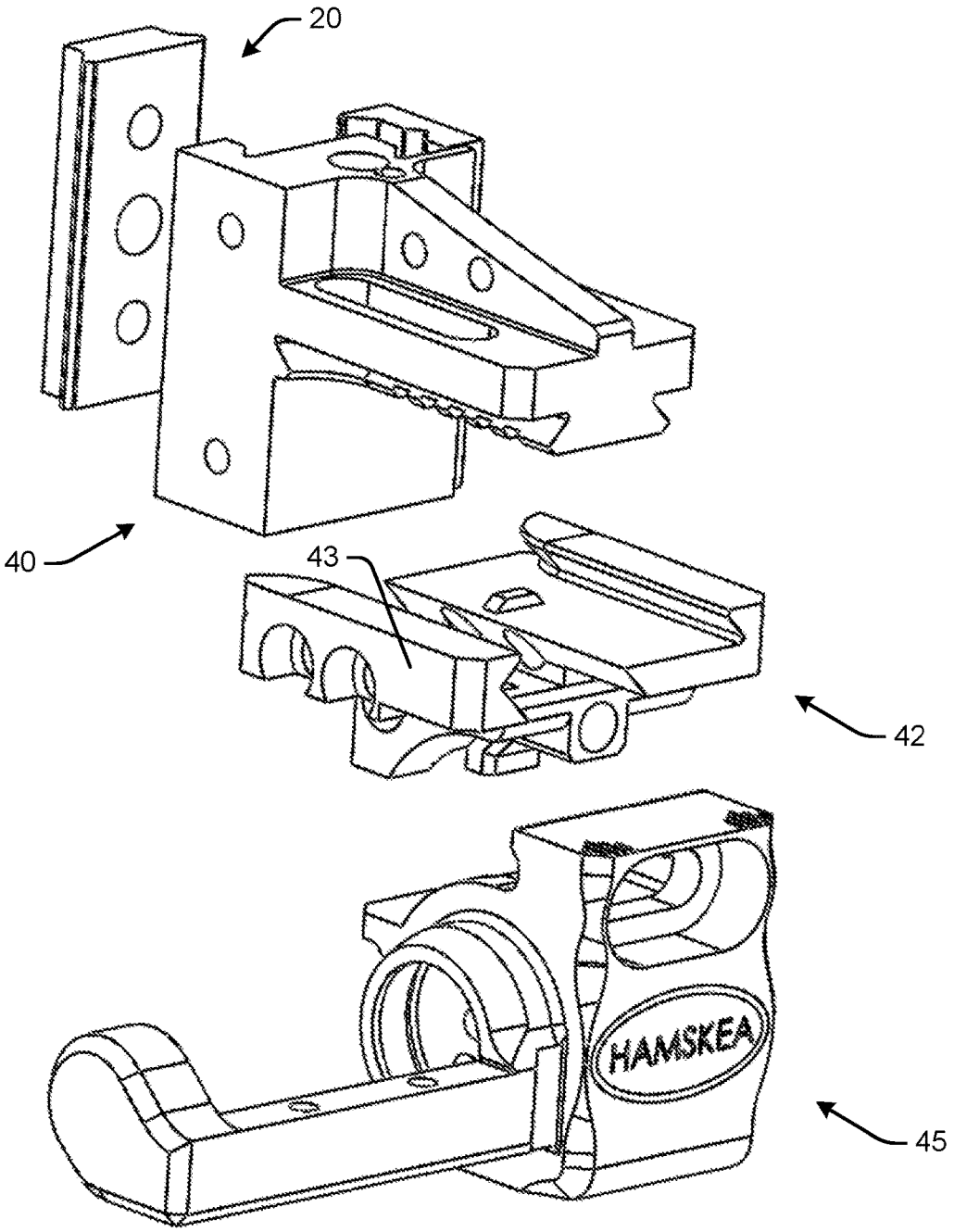

FIGS. 12 and 13 are perspective views of the example polygon shaped mount 20 and a rest coupler or coupler mount 40. In this example, the coupler mount 40 is shown having a separate clamp 41 and an intermediate block 42. The intermediate block 42 is shown with a separate clamp 43 and alignment protrusion 44 for positioning an accessory 45.

Figure 14:
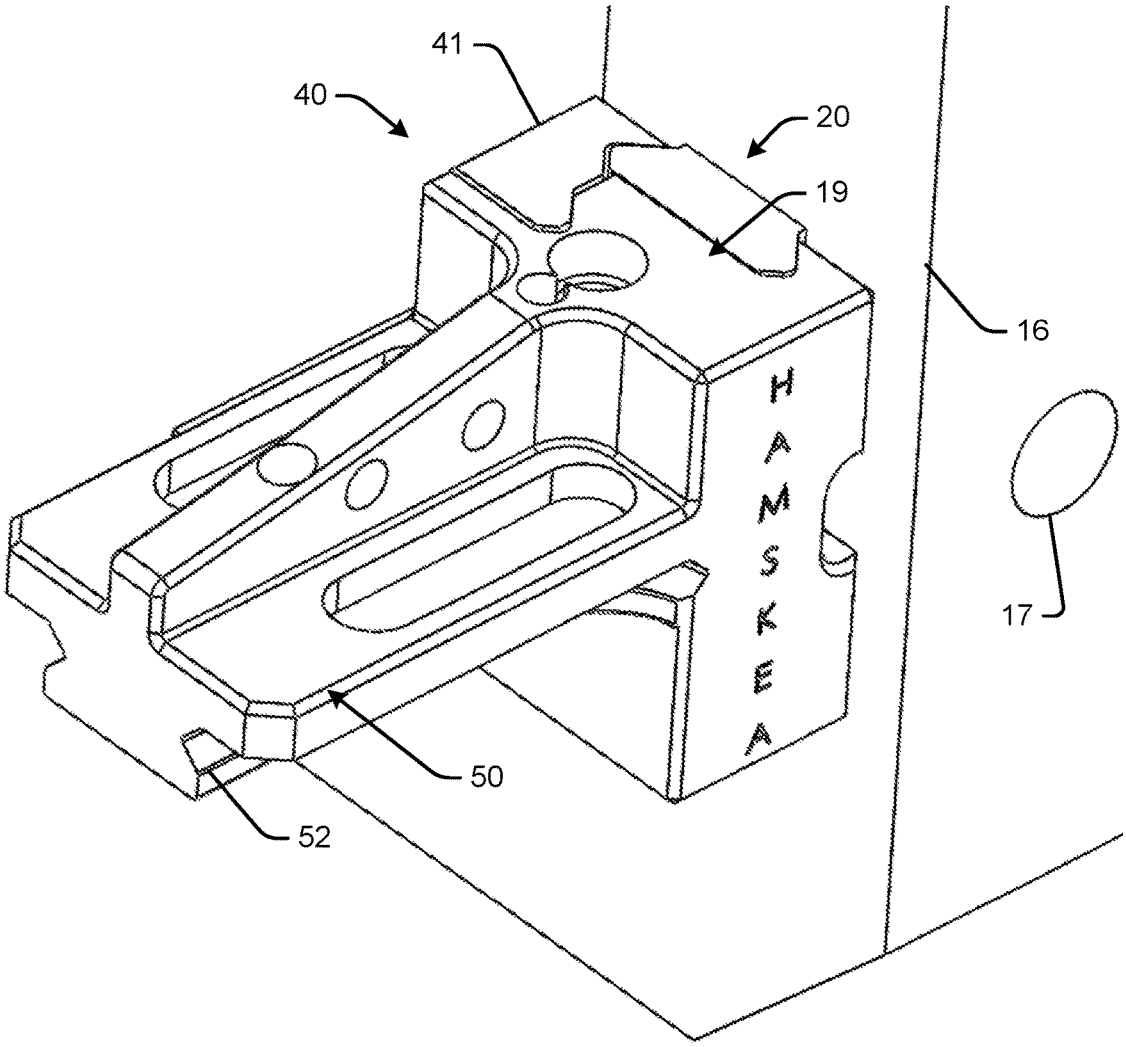
FIGS. 14 and 15 are perspective views of the polygon shaped mount bracket and T-shaped coupler mounted to a bow system.
Figure 15:
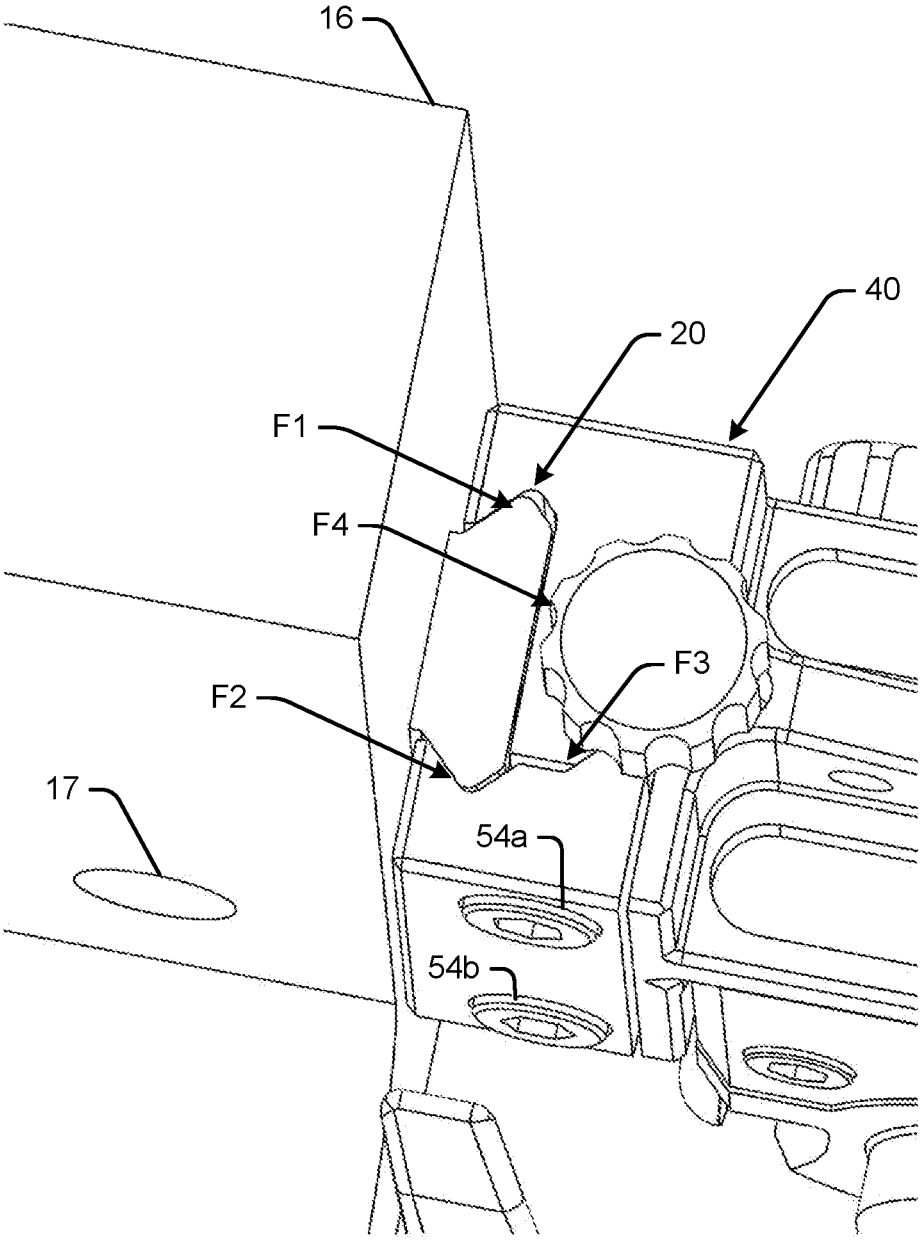

FIGS. 14 and 15 are perspective views of the mounting bracket 20 and coupler 40 with separate clamp 41 mounted to an aft surface 18 or plane of the bow riser 16. The Berger hole 17 is seen on bow riser 16 in FIG. 14. Also seen in FIG. 14 is the plank 50 of the coupler 40. Multiple co-linear alignment surfaces 52 of the coupler 40 are also visible in FIG. 14. Threaded fasteners 54*a*, 54*b* of the coupler 40 are visible in FIG. 15. FIG. 15 also illustrates clamping force F1, clamping force F2, clamping force F3, and clamping force F4. Where the force F4 is orthogonal to the bow riser 16 mounting surface to press the coupler protrusion 82 into the geometrically shaped mount 20 receiving feature 26 for a friction or interference fit.

Figure 16:
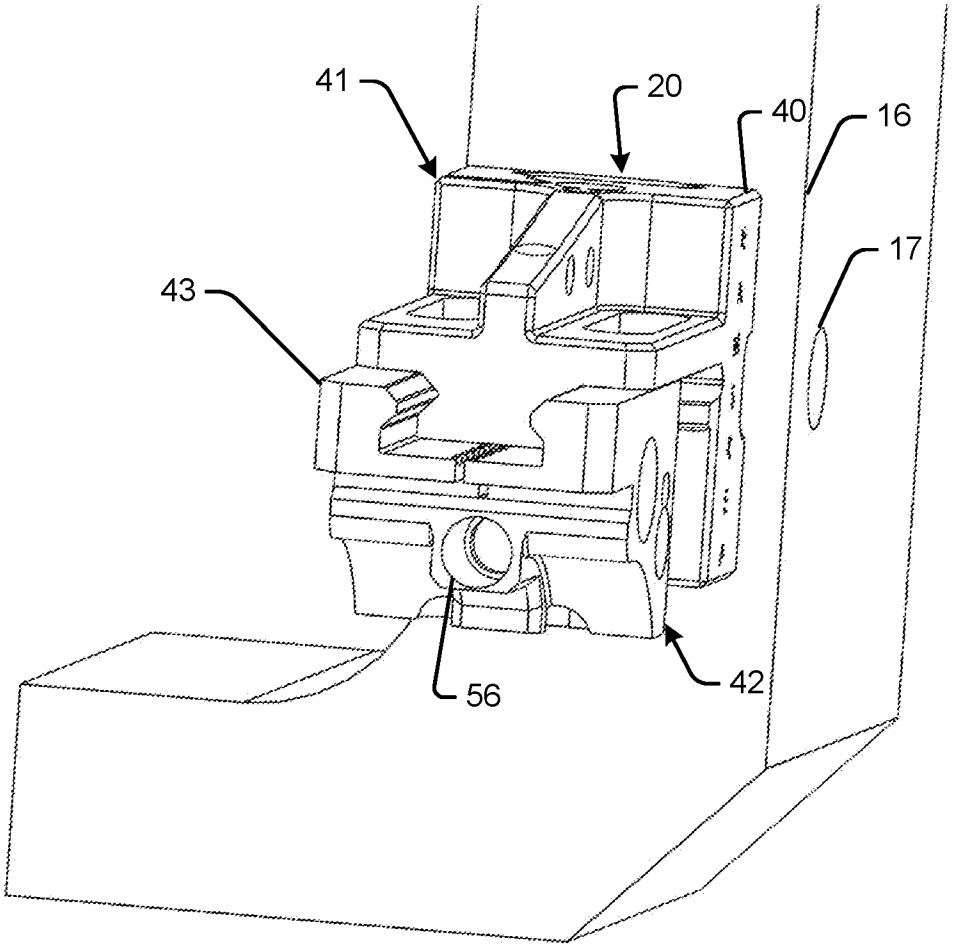
FIGS. 16-18 are perspective views of the polygon shaped mount and T-shaped coupler shown in FIGS. 14 and 15 with an intermediate block.
Figure 17:
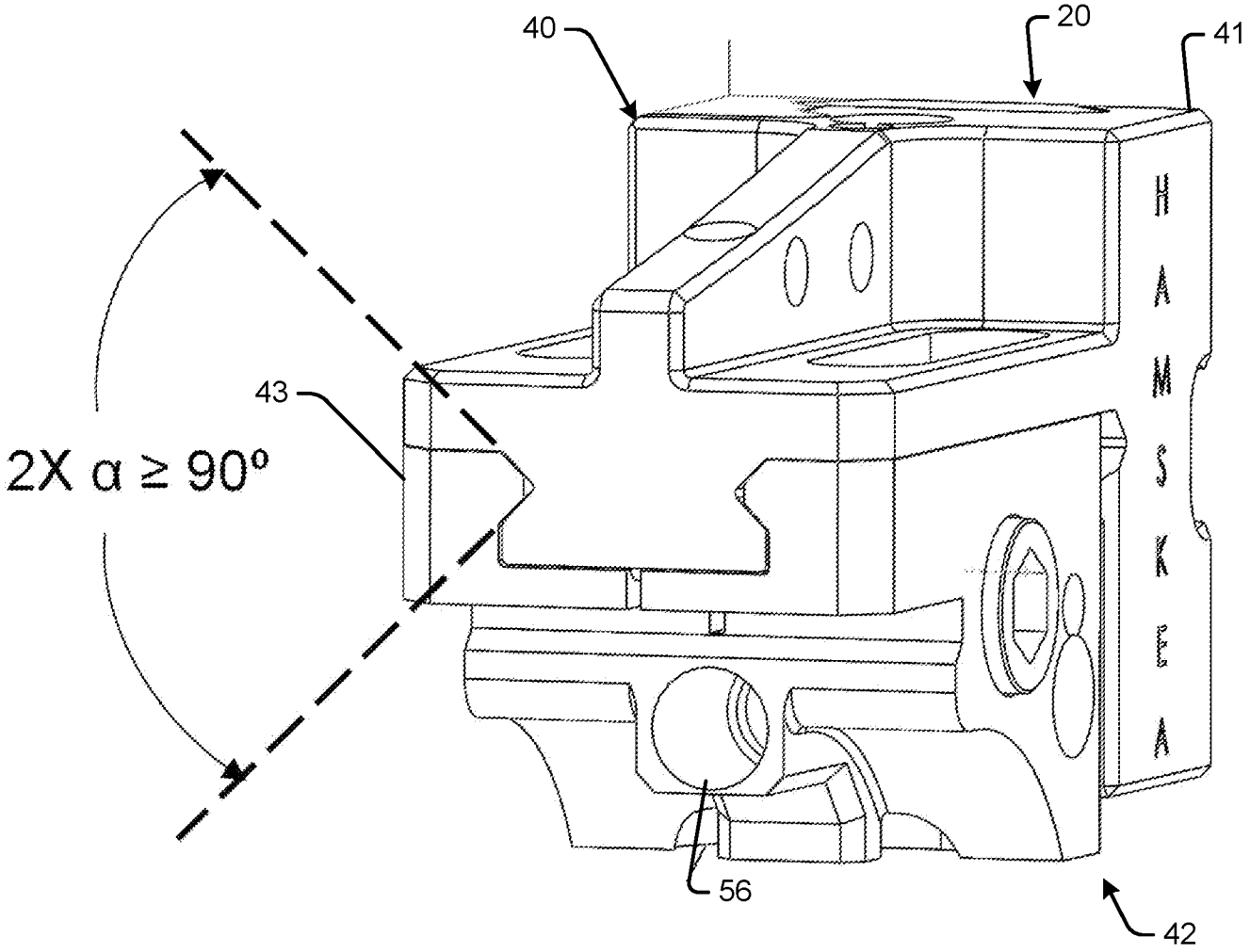
Figure 18:
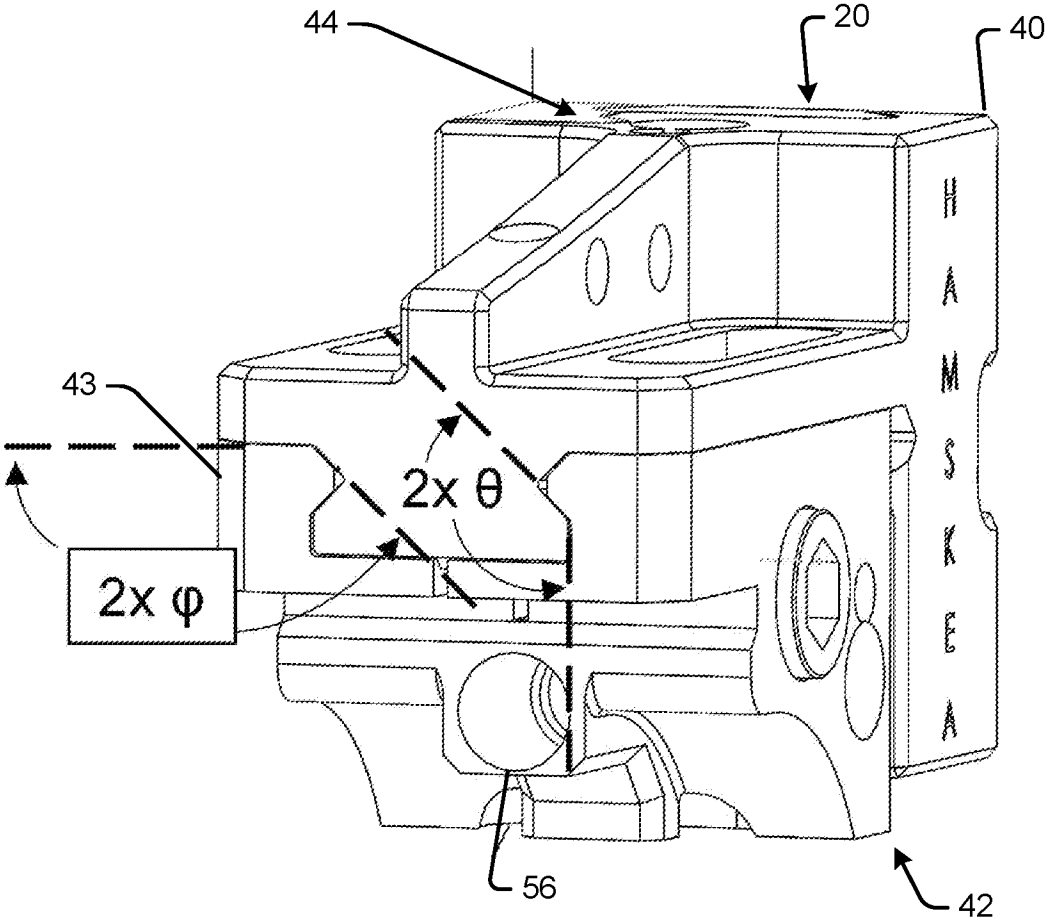

FIGS. 16-18 are perspective views of the mounting bracket 20 and coupler 40 with separate clamp 41 shown in FIGS. 14 and 15 and having the intermediate block 42 with separate clamp 43. A threaded extruded boss feature 56 is also visible in FIGS. 16-18.

Figure 19:
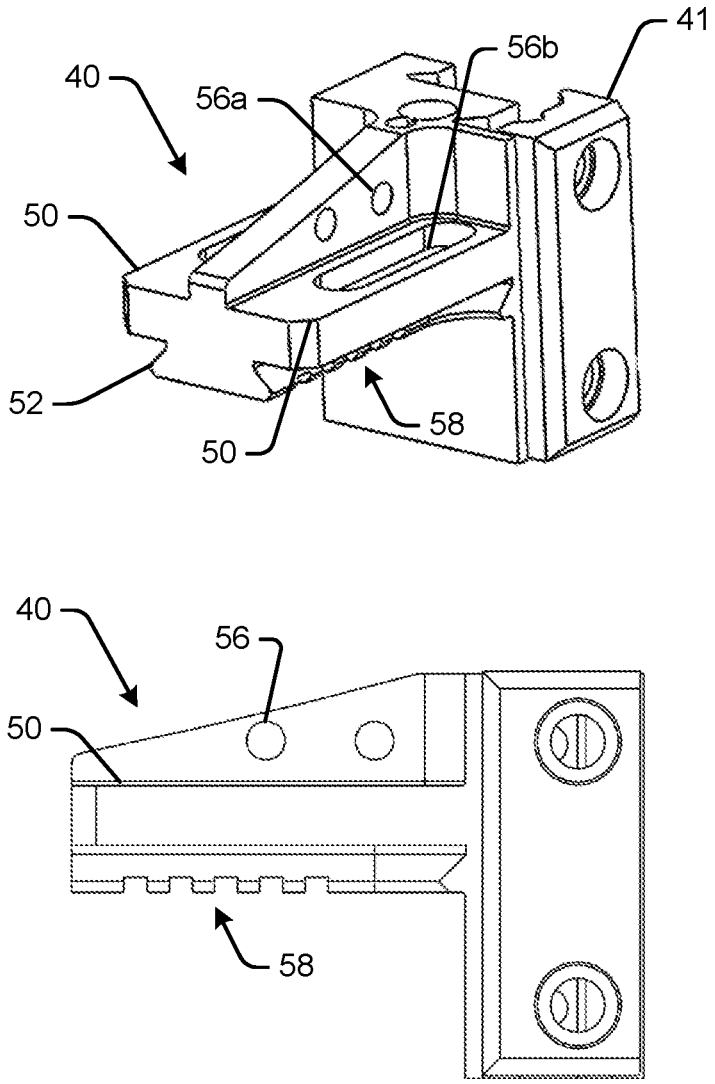
FIGS. 19-20 are perspective views of the T-shaped coupler illustrating mounting features.
Figure 20:
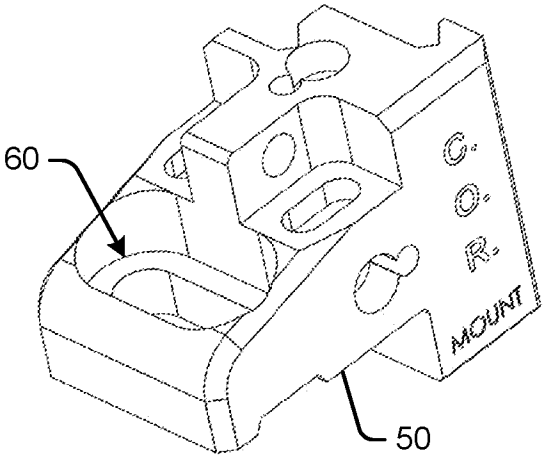
Figure 20:
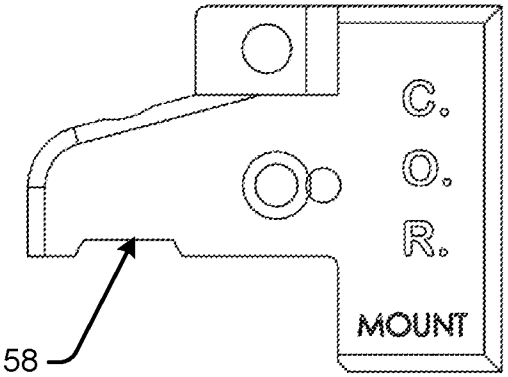
Figure 20:
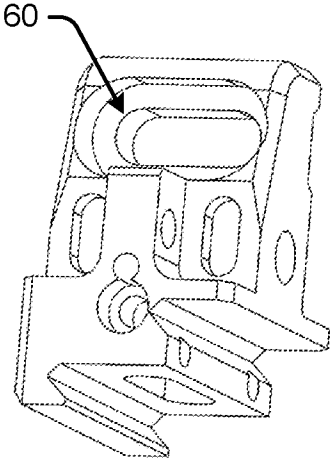
Figure 21:
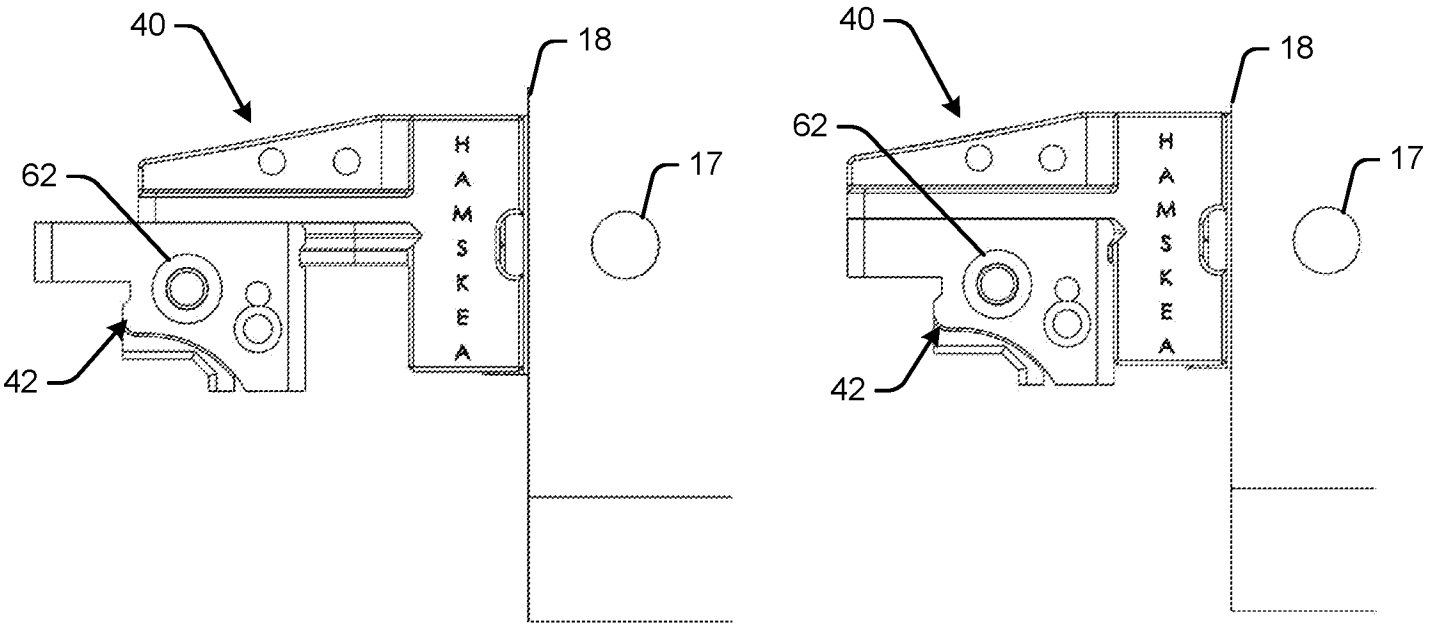
FIG. 21 is a perspective view of the polygon shaped mount, T-shaped coupler and intermediated block illustrating a threaded opening to apply a clamping force.

FIGS. 19-20 are perspective views of the coupler 40 illustrating mounting features, including the separate coupler clamp 41, plank 50 and protrusions with edges and guide surfaces 52. Mounting features 56 for the top containment bracket 200 are shown in FIG. 19. Multiple intersecting channels 58 are also visible in the side view shown in FIG. 19 and FIG. 20. A through hole or slot 60 for mounting a fastener is visible in FIG. 20 FIG. 21 are side views of the coupler 40 and intermediate block 42 illustrating a threaded opening 62 to apply a clamping force to mount the intermediate block 42 to the coupler 40.

Figure 22:
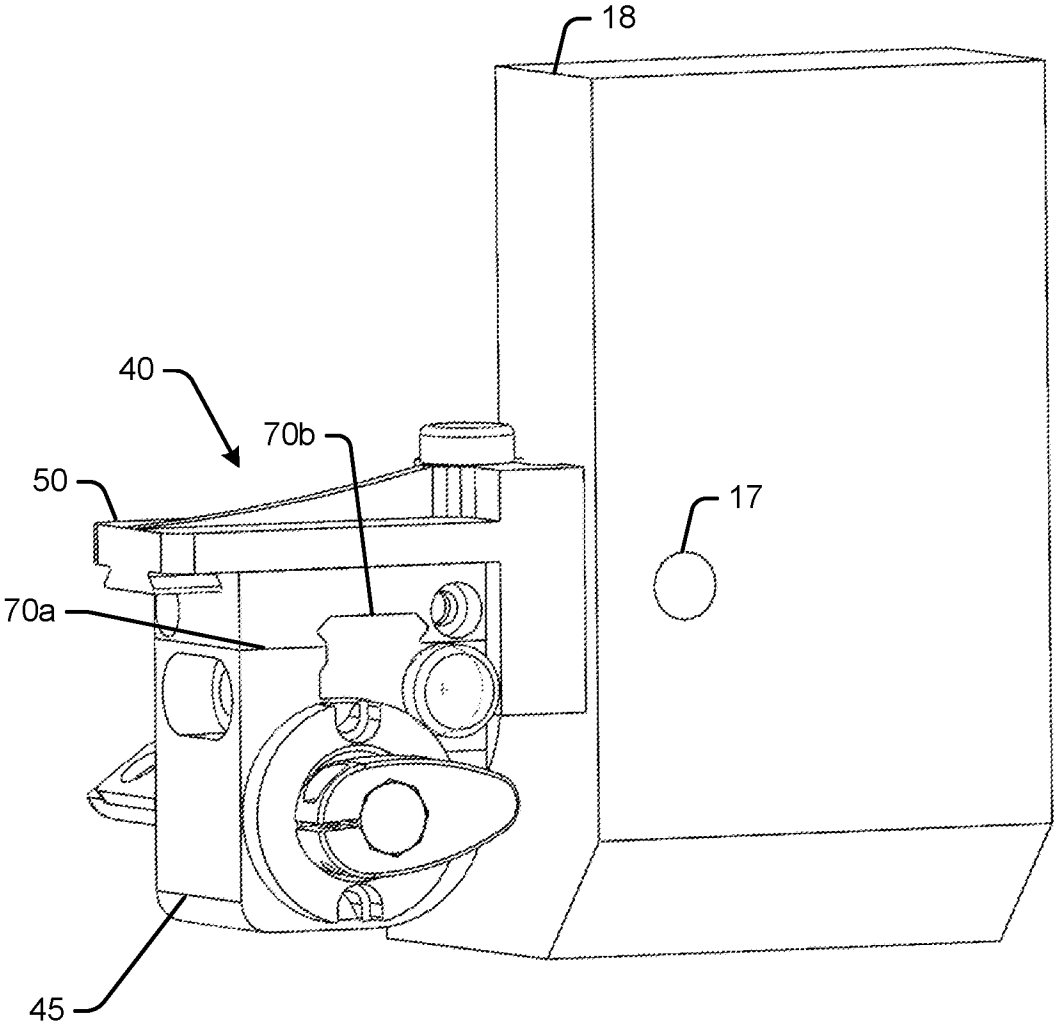
FIGS. 22-23 are perspective views of a two-piece dovetailed intermediate block with accessory.
Figure 23:
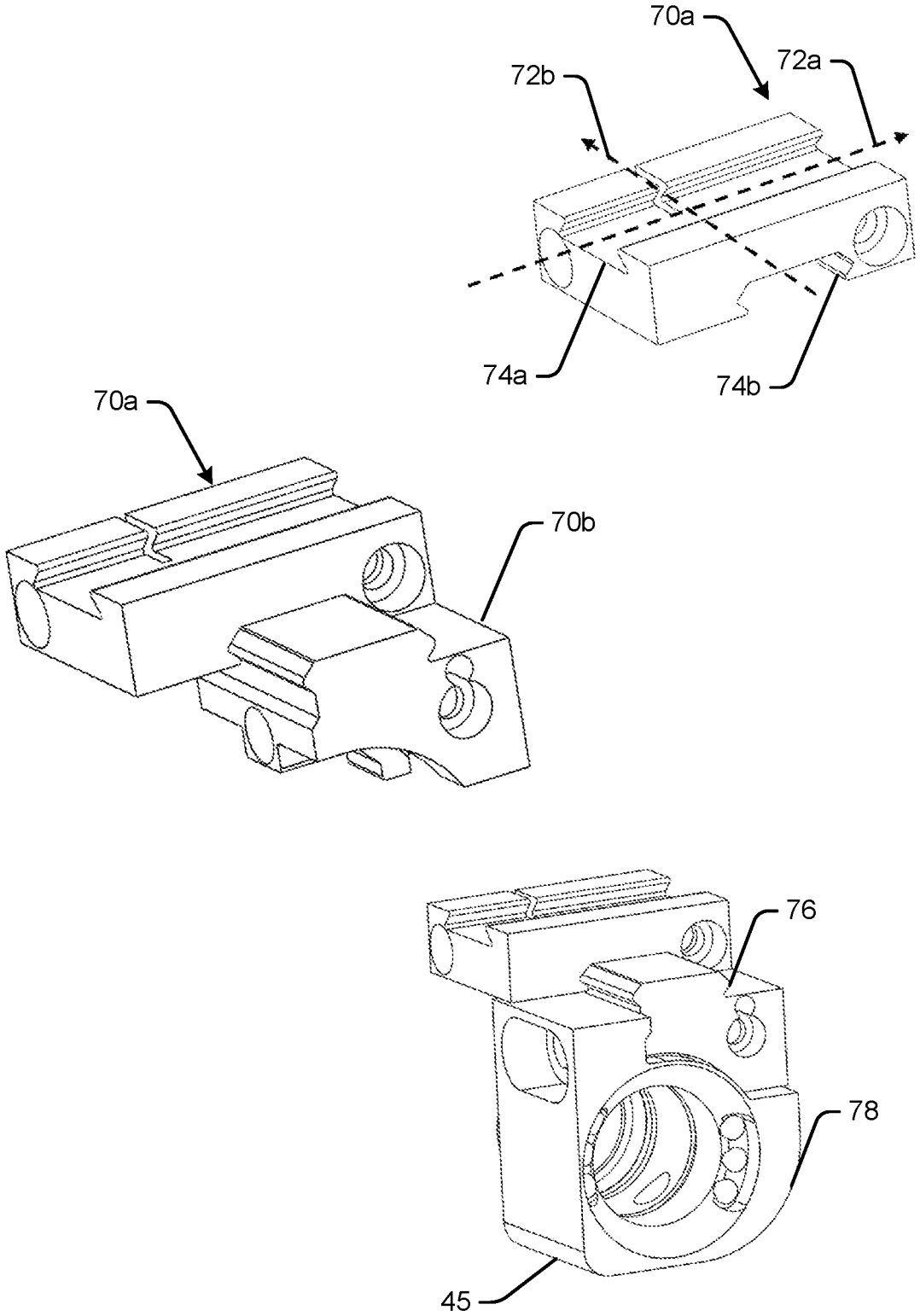
Figure 24:
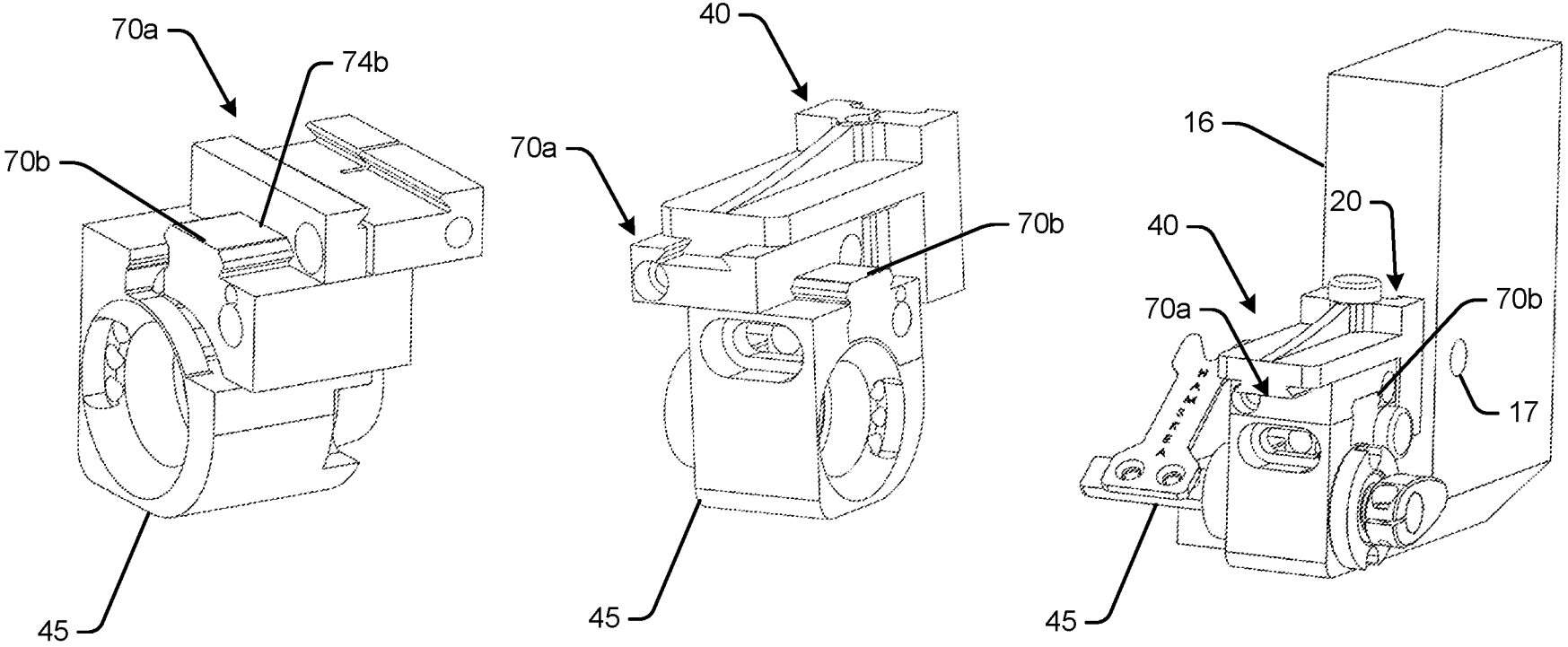
FIG. 24 are perspective views of the mounting bracket and coupler illustrating a two-piece intermediate block.

FIGS. 22-24 shows perspective views of the coupler 40 illustrating a two-piece intermediate block 70*a*, 70*b* having a dovetail feature 74*a* and 74*b*. FIG. 23 shows the intermediate block 70*a* having a plank axis 72*b* orthogonal to the forward aft axis 72*a* of the plank 50. Dovetail feature 74*b* engages with mating dovetail feature 76 of a carriage 78 for accessory 45.

Figure 25:
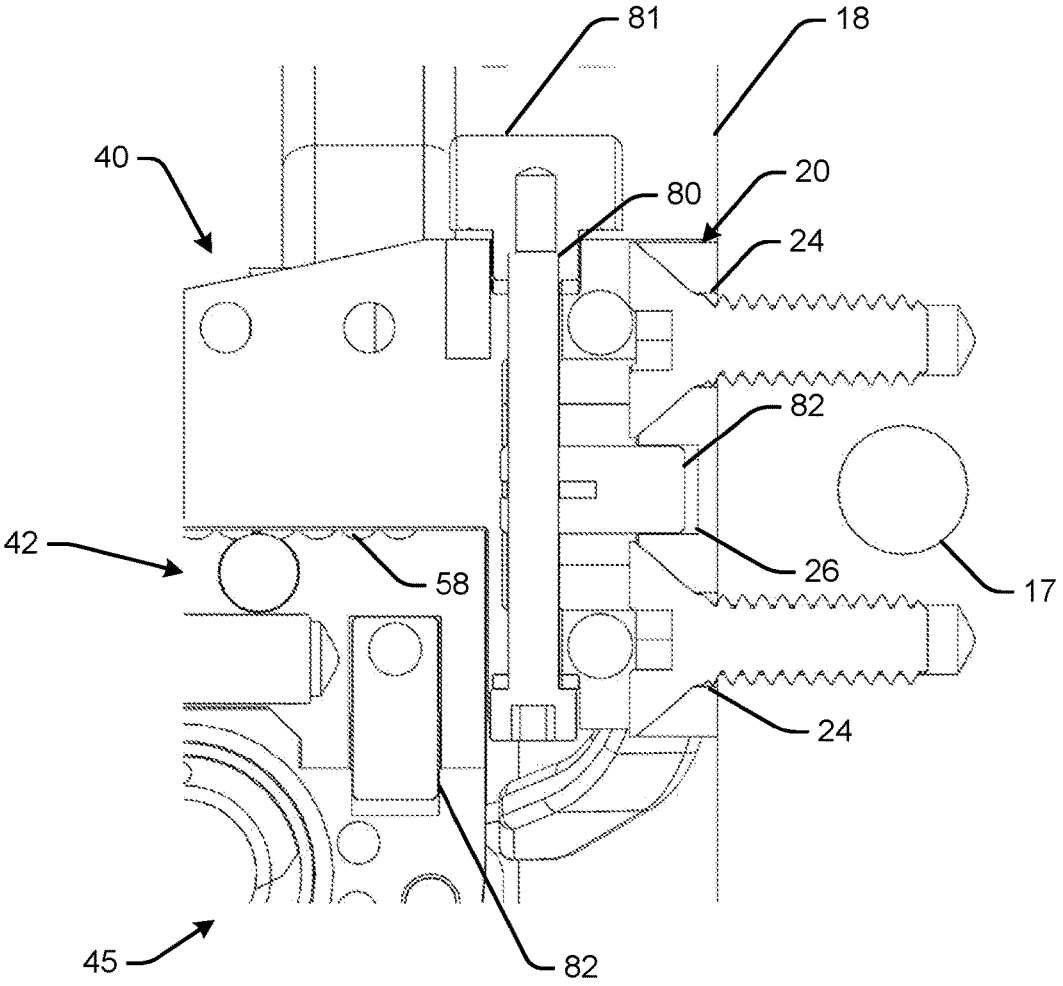
FIG. 25 is a side view of the mounting bracket and coupler illustrating a microtune adjustment.
Figure 26:
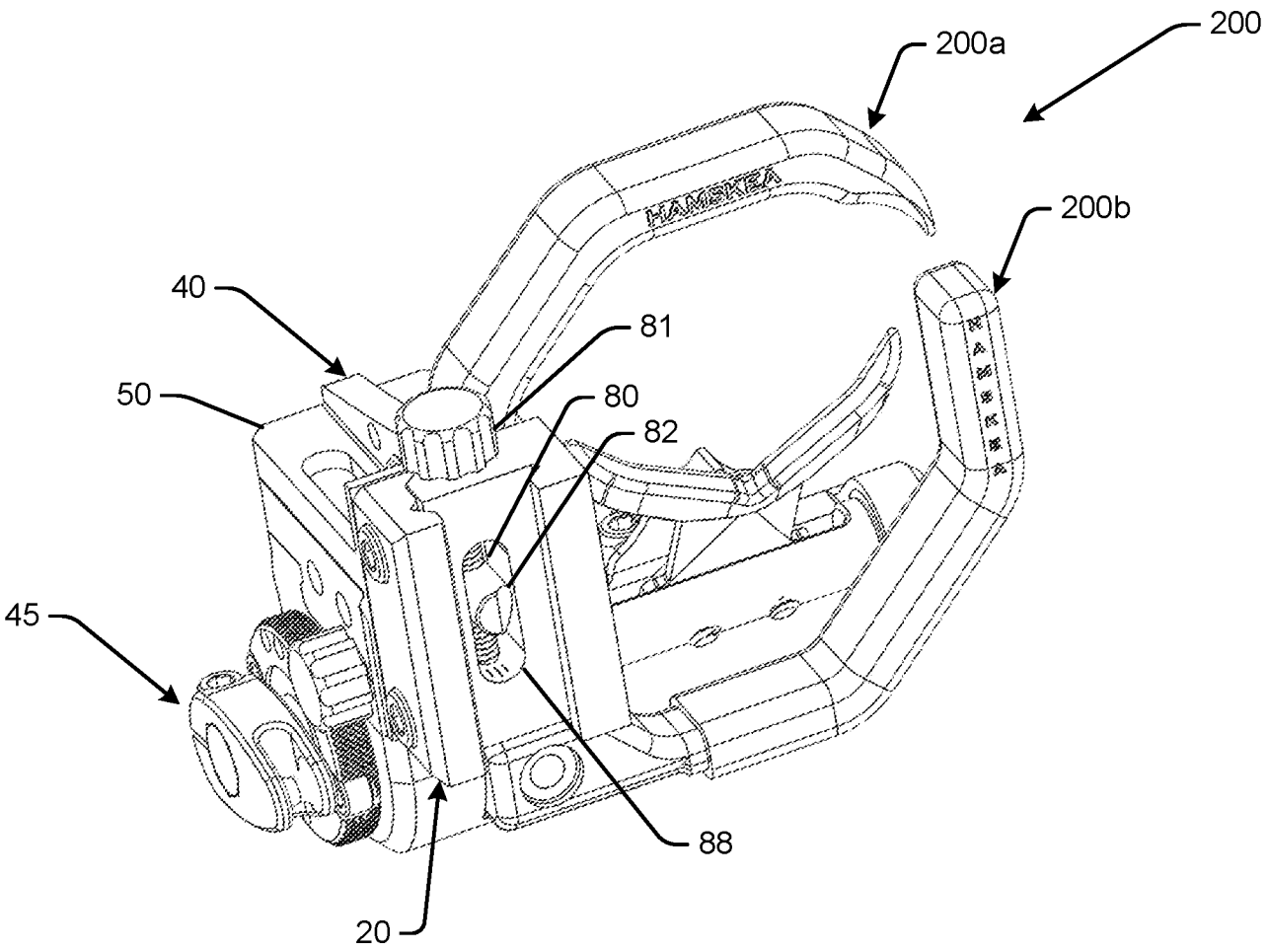
FIG. 26 further illustrate the microtune adjustment as part of the T-shaped coupler.
Figure 27A:
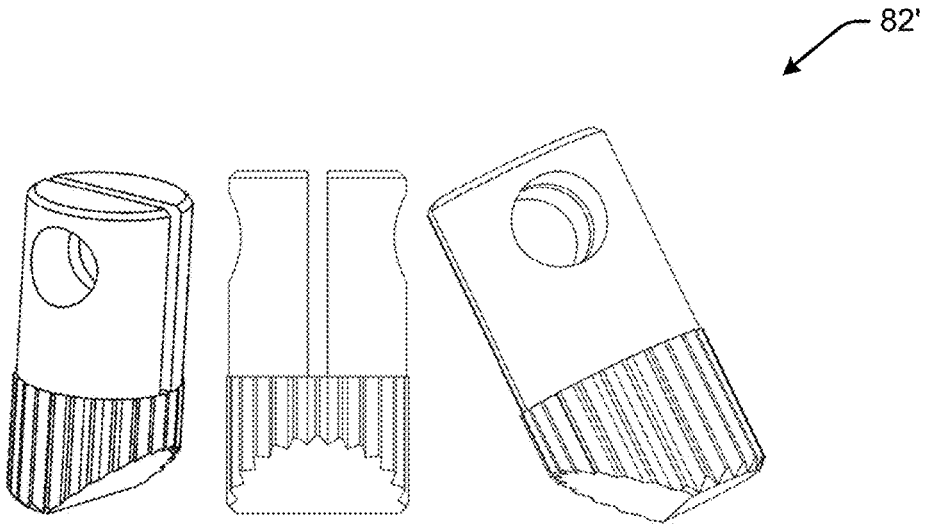
FIGS. 27A and 27B illustrate example protruding features of the microtune peg, including (A) splines and (B) knurling.
Figure 27B:
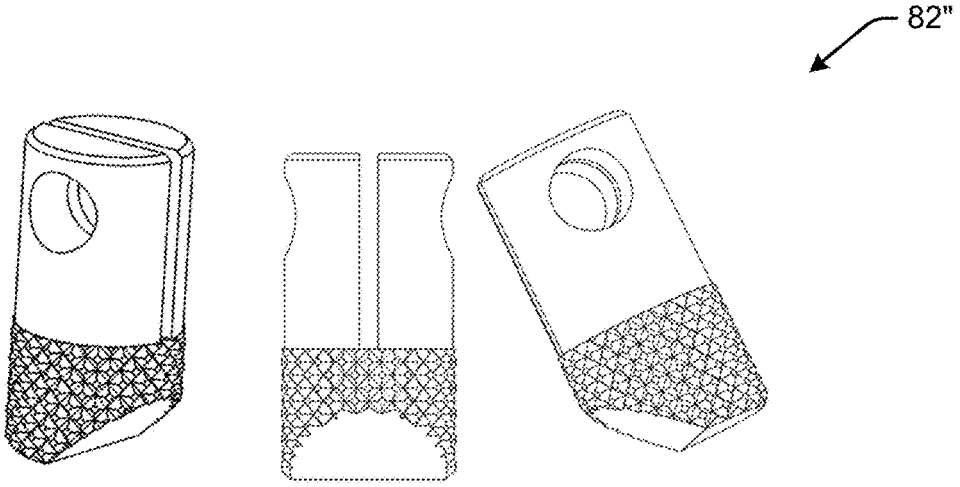

FIG. 25 is a cross-sectional side view of the mounting bracket 20 and coupler 40 illustrating a microtune adjustment. FIGS. 26-27 further illustrate the microtune adjustment. The microtune adjustment may be accomplished with threaded axial member 80 by rotating knob 81. Peg 82 is better seen in FIG. 27 having a threaded opening or hole 83 for the threaded drive mechanism 80. Peg 82 includes a protruding surface 84, a chamfer 85, and a slot 86. The chamfer is for rotatable installation. FIGS. 27A and 27B illustrate example protruding features of the microtune peg, including (A) splines on the peg embodiment 82' and (B) knurling on the peg embodiment 82"

Figure 28:
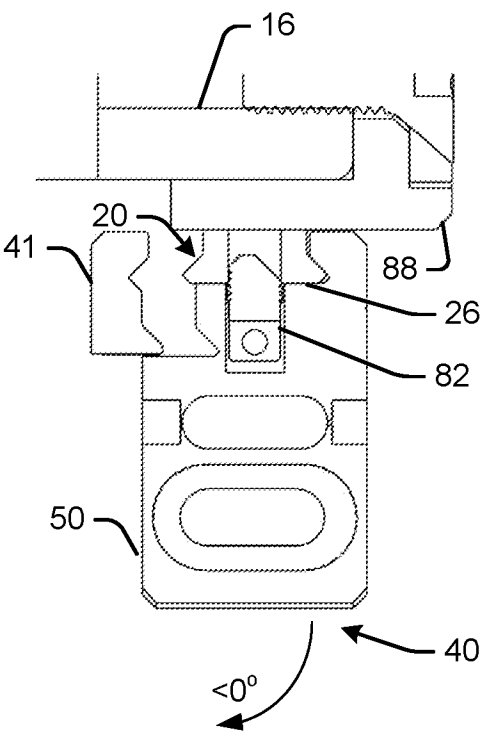
FIG. 28 illustrates rotational coupling motion for attaching a T-shaped coupler to the polygon shaped mount with a microtune peg and separate clamp.
Figure 28:
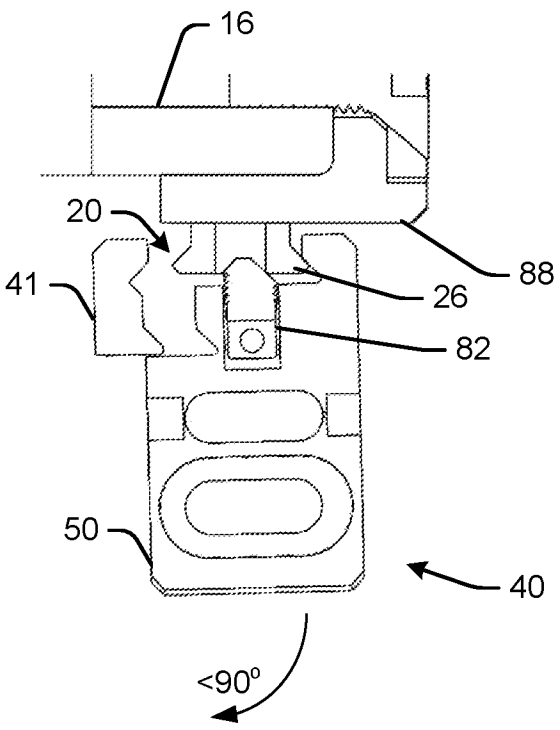
Figure 28:
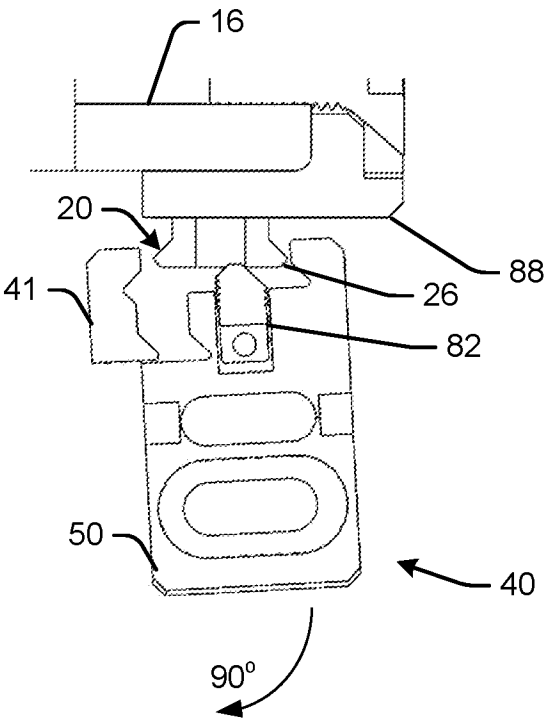
Figure 29:
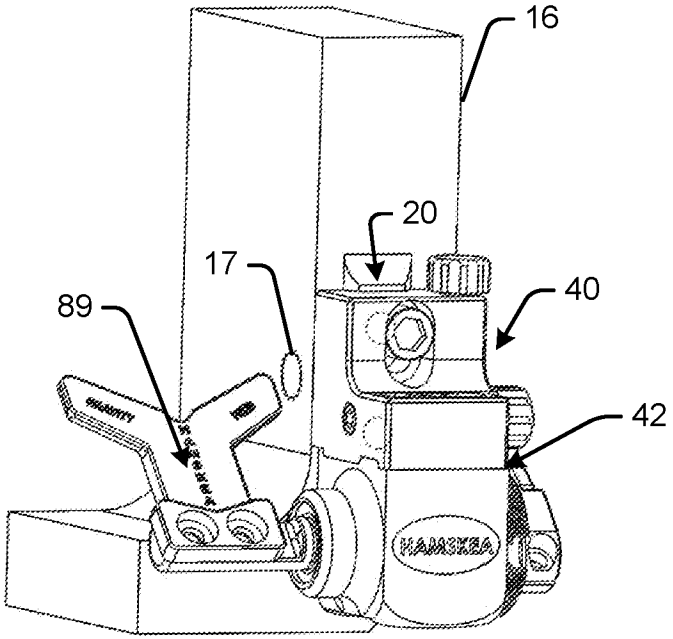
FIGS. 29-32 illustrate multiple vertical mounting surfaces and microtune peg receiving feature machined into the bow riser.
Figure 29:
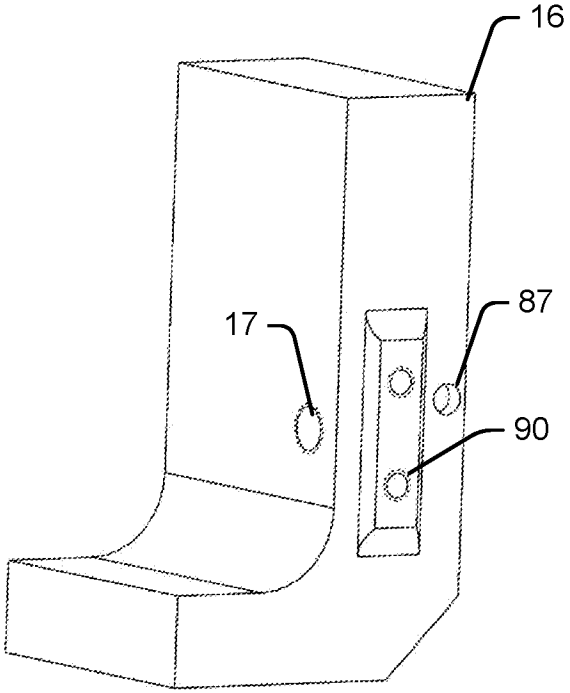

FIG. 28 illustrates attaching a coupler 40 to the polygon shaped mount 20 with a microtune peg 82 as part of the microtune mechanism and separate clamp 41. The polygon shaped mount 20 shown is a polygon shaped mount on an L-shaped bracket 30 on the bow riser 16. The views show the need for the chamfer feature on peg 82 to enable the T-shaped coupler 40 and clamp 41 with integral microtune mechanism with peg 82 to be rotationally coupled to the receiving hole 26 or 24 in the polygon shaped mount 20.

Figure 30:
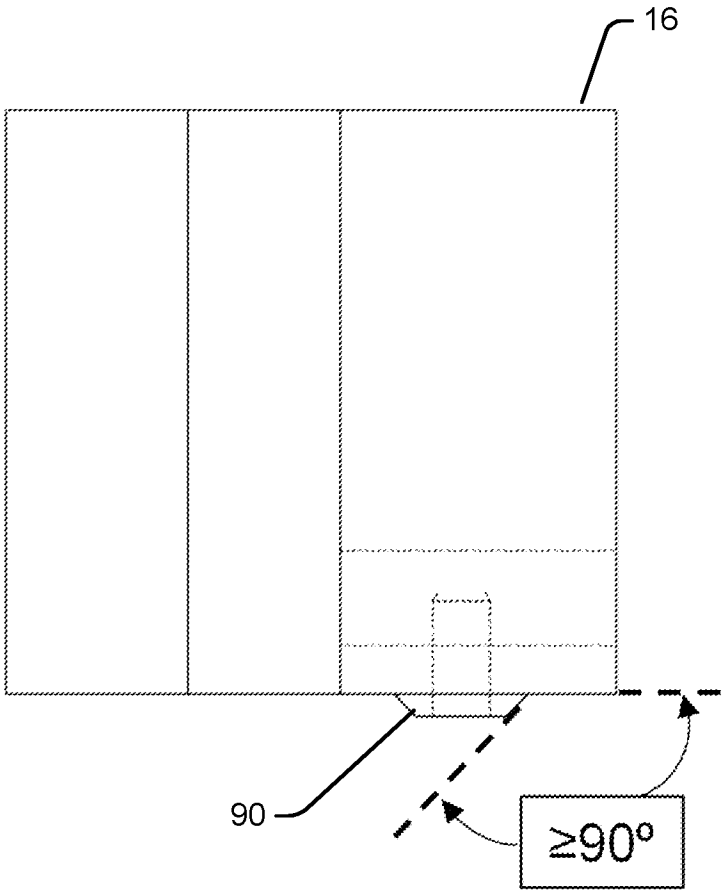
Figure 31:
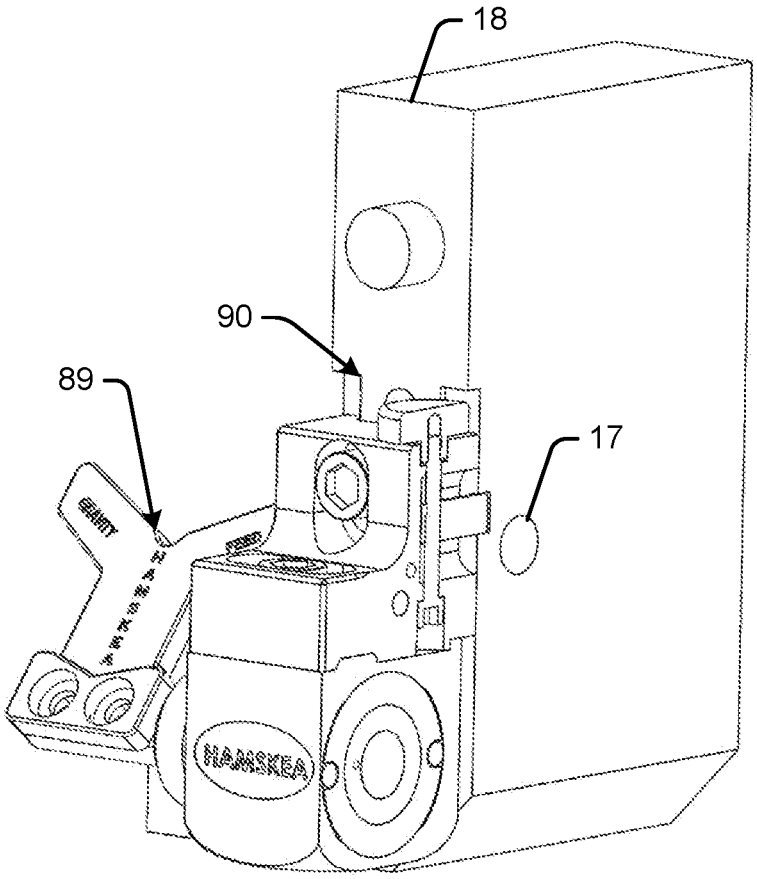
Figure 32:
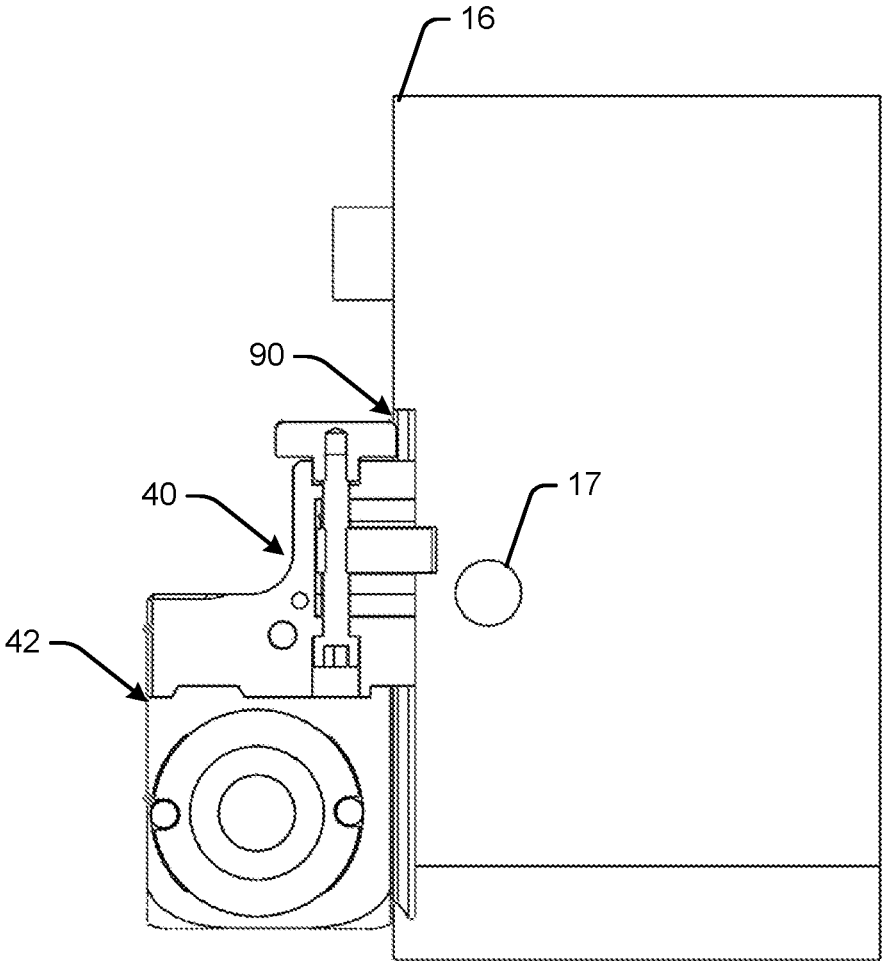

FIGS. 29-32 illustrate multiple vertical mounting surfaces 90 and microtune peg receiving feature 87 machined into the bow riser 16. FIG. 30 shows a top view of the bow riser 16. It is noted that more than one microtune peg receiving feature 87 may be provided. Multiple attachment features 90 may be provided in the bow riser for the fastener. Multiple vertical mounting surfaces with 90 degree or greater angles may be machined into the bow riser 16. In the example shown, a rotating shaft with launcher accessory 89 is illustrated.

Figure 33:
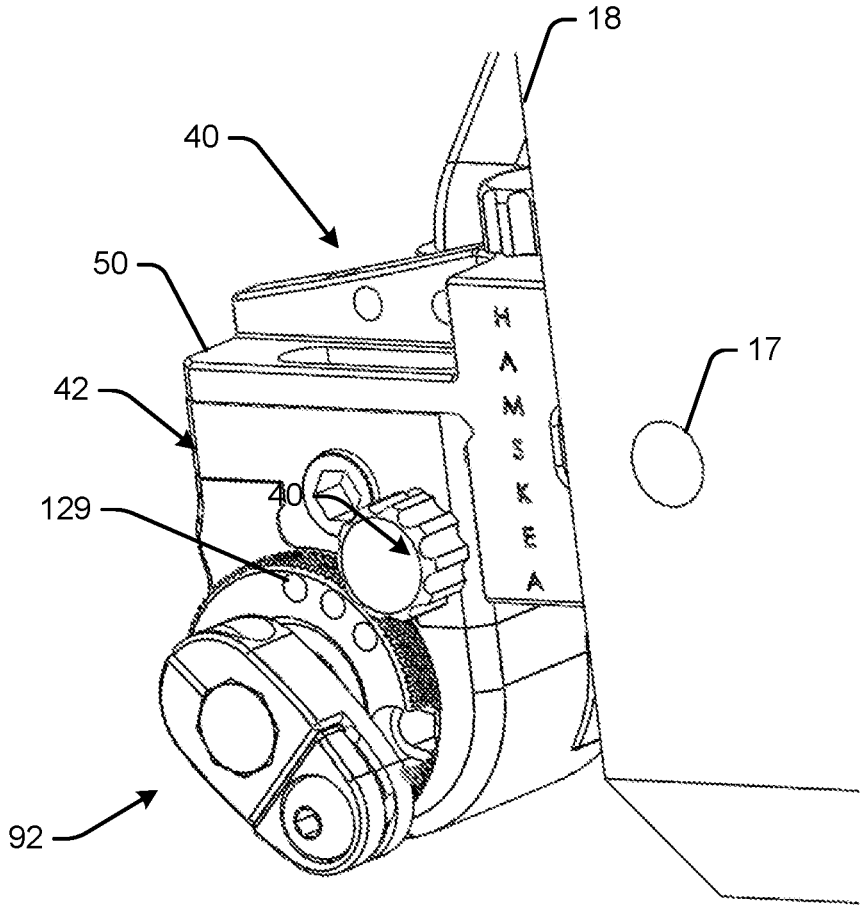
FIGS. 33-34 illustrate implementation of the polygon shaped mount bracket and T-shaped coupler with a cord lever arm assembly.
Figure 34:
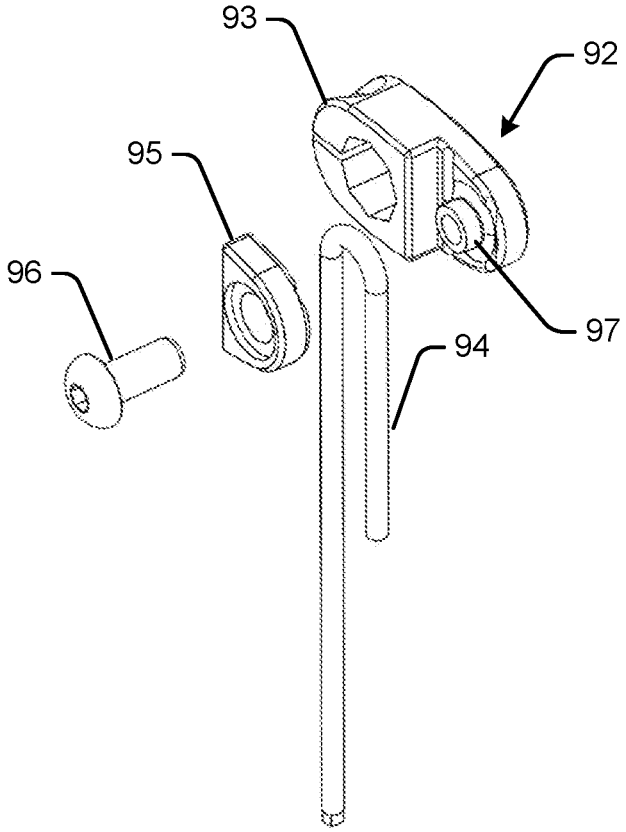
Figure 35:
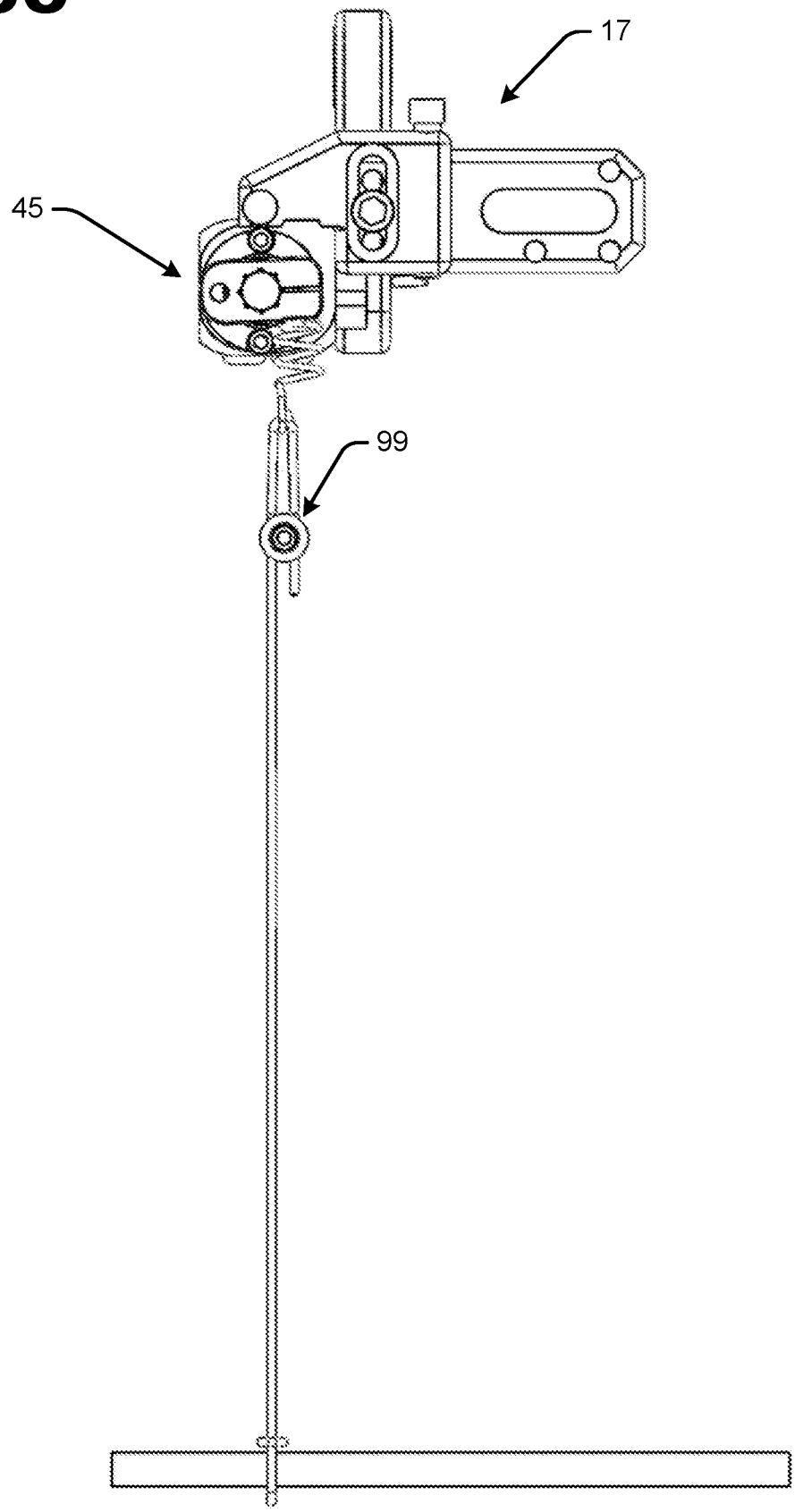
FIG. 35 illustrates lever arm assembly without clamp feature.

FIGS. 33-35 illustrate implementation of the mounting bracket and coupler with a cord accessory 92. In FIG. 34, the lever arm assembly 92 is shown having a lever arm 93, looped cord 94, lever arm clamp 95 and clamp fastener 96. The cord accessory clamp 99 that the two-peice lever arm assembly replaces is shown assembled in FIG. 35.

Figure 36:
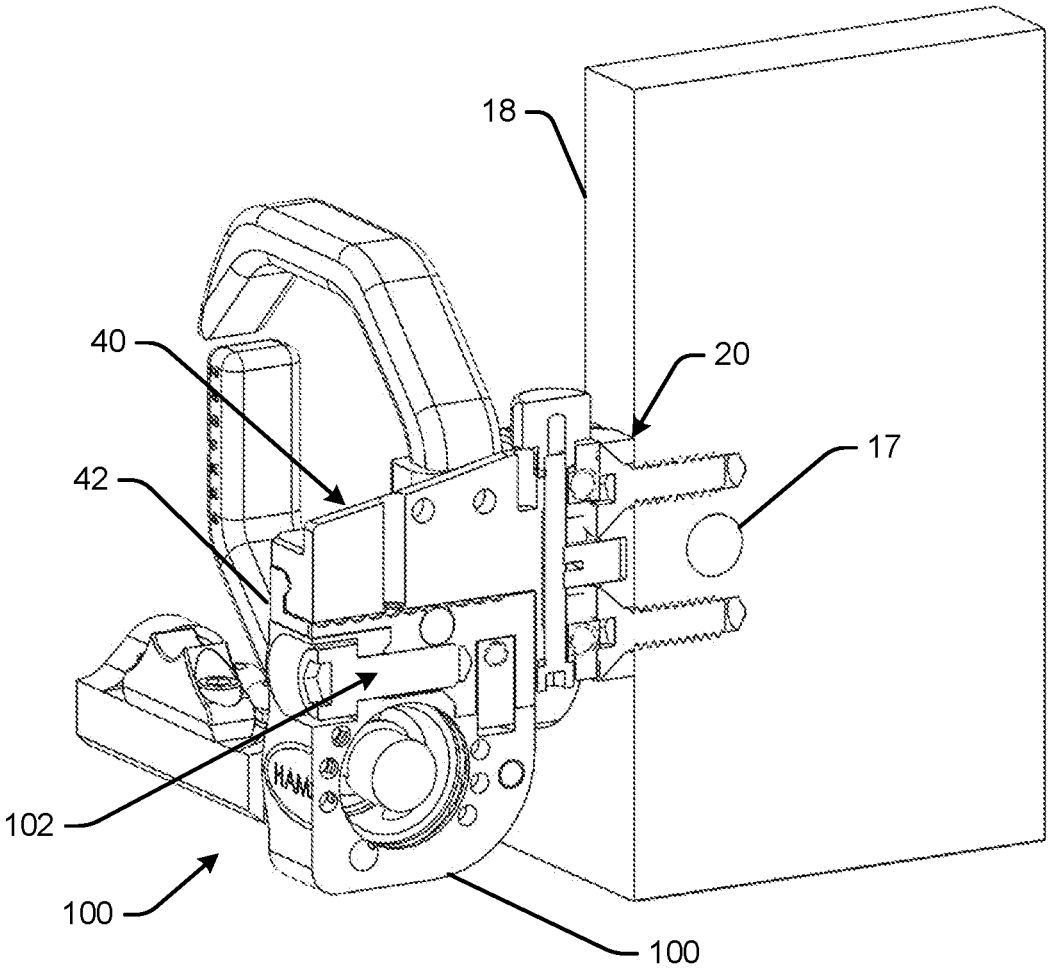
FIGS. 36-37 illustrate cross section views of microtune with peg and ball detent feature.
Figure 37:
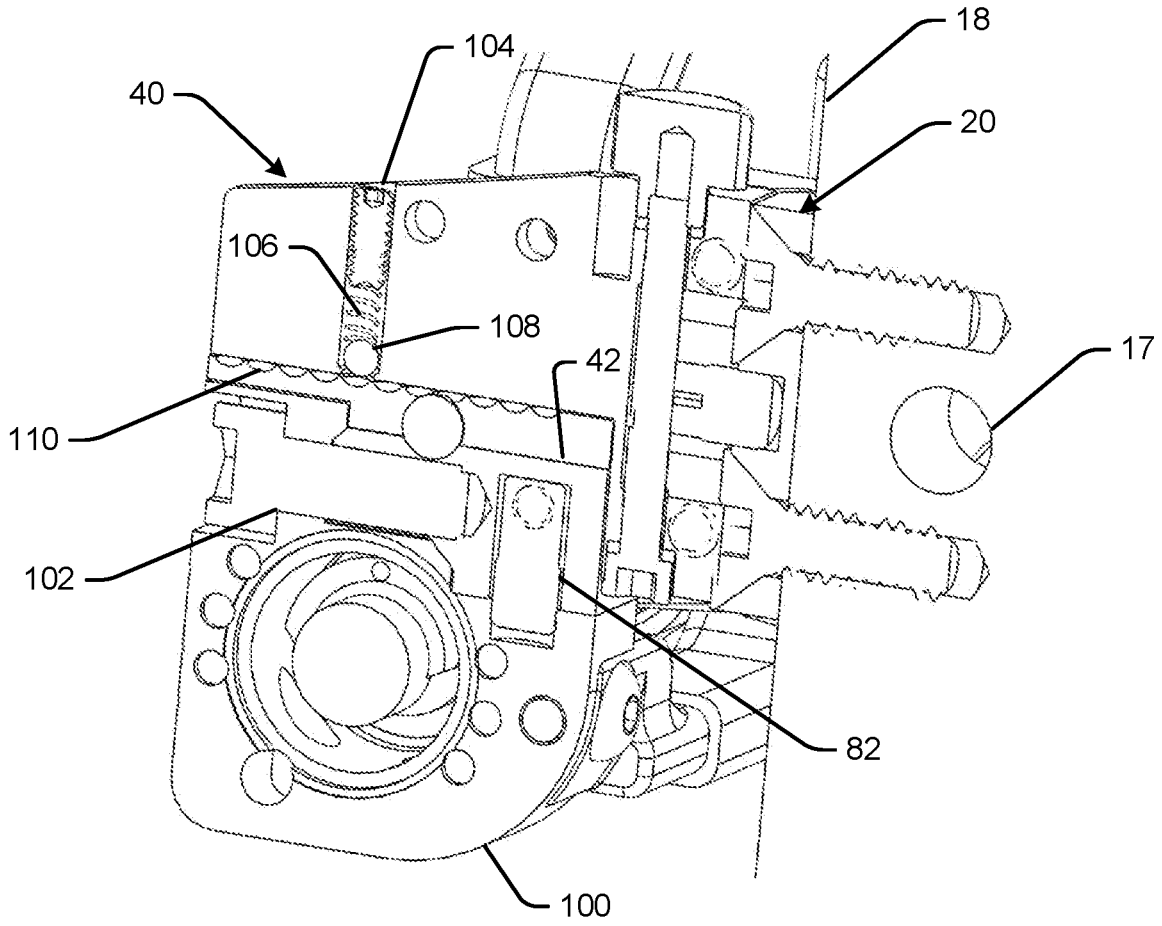

FIGS. 36-37 illustrate an accessory carriage 100 attached to the intermediate block 42 and coupler 40. A body lateral locking fastener 102 is shown attached to the intermediate block 42. FIG. 37 illustrates a cross-sectional view of FIG. 36, and shows a detent spring compression device 104 with detent spring 106, and detent sphere or ball 108. Multiple receiving detent features 110 are also illustrated in the intermediate block 42.

Figure 38:
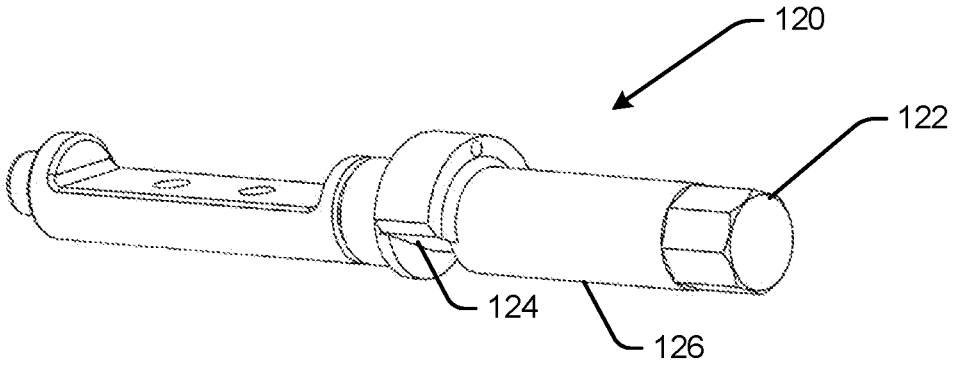
FIG. 38 illustrates the rotating shaft of the accessory.
Figure 39:
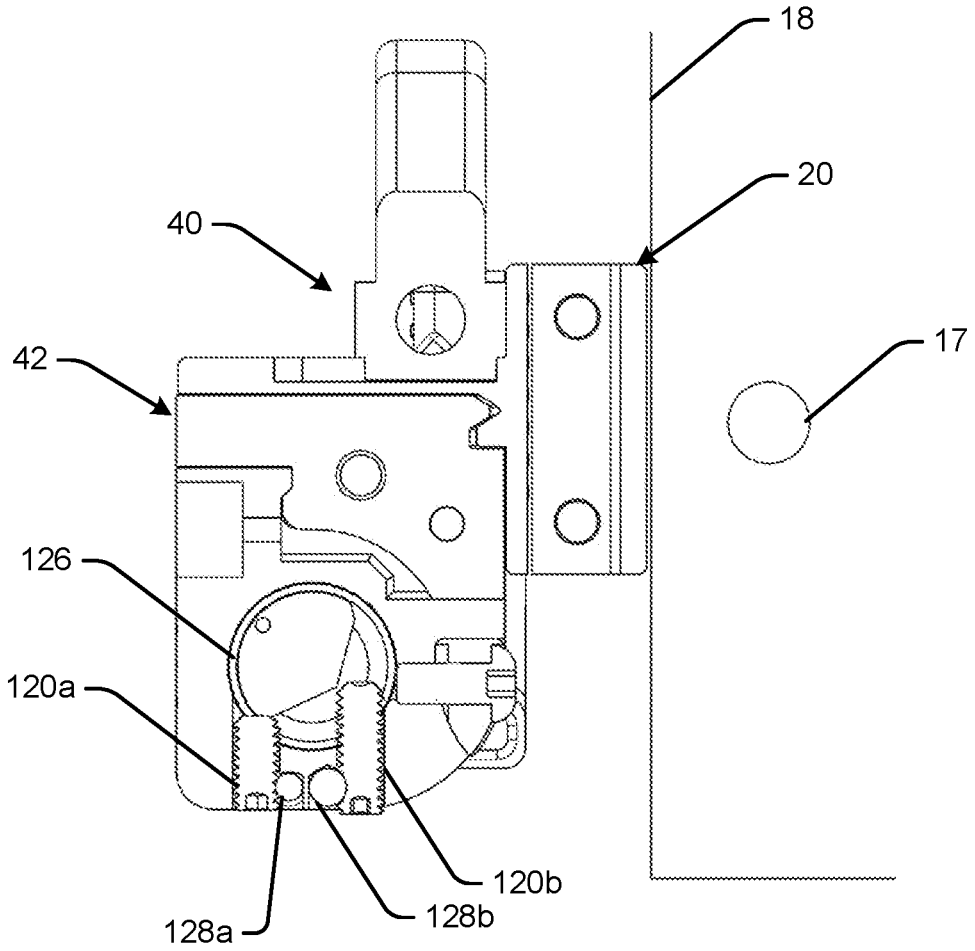
FIG. 39 illustrate adjustable headless set screws
Figure 40:
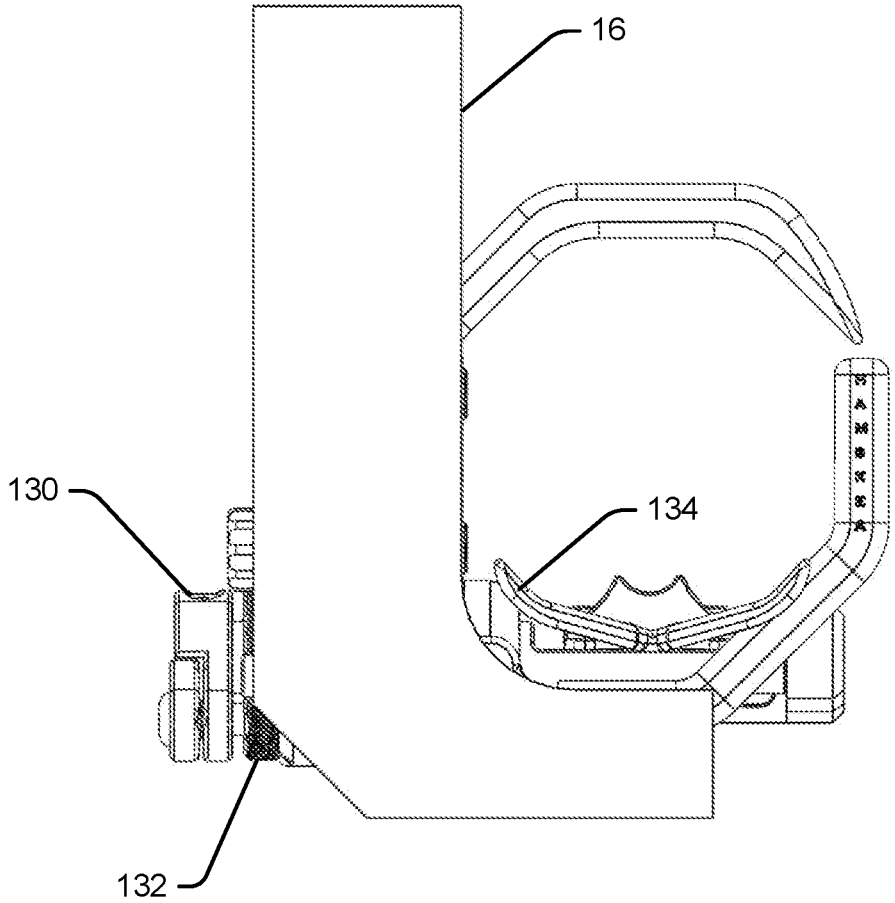
FIG. 40 illustrates forward looking aft view of the arrow rest assembly with lever arm assembly in the DOWN position FIG. 41 illustrate shaft rotation and headless set screw interfaces in the UP and DOWN positions.

FIGS. 38-40 illustrate the rotating shaft 120 of accessory 45 having a geometric or other polygon (e.g., octagon) shaped shaft end 122 and multiple compound surfaces 124 that interface with for rotation/angle integral features provided the carriage 100. The rotating shaft 126 of set screws 120*a* and 120*b* are seen assembled in FIG. 39. The headless set screw 120*a* set the launcher UP angle of the arrow rest body. Another headless set screw position 120*b* sets the launcher in the DOWN angle. Corresponding spherical locking devices 128*a*, 128*b* are also seen in FIG. 39. FIG. 40 shows a 2-piece lever arm 130 and a knurled spring knob 132. The angled launcher 134 accommodates the bow riser 16 geometry.

Figure 41:
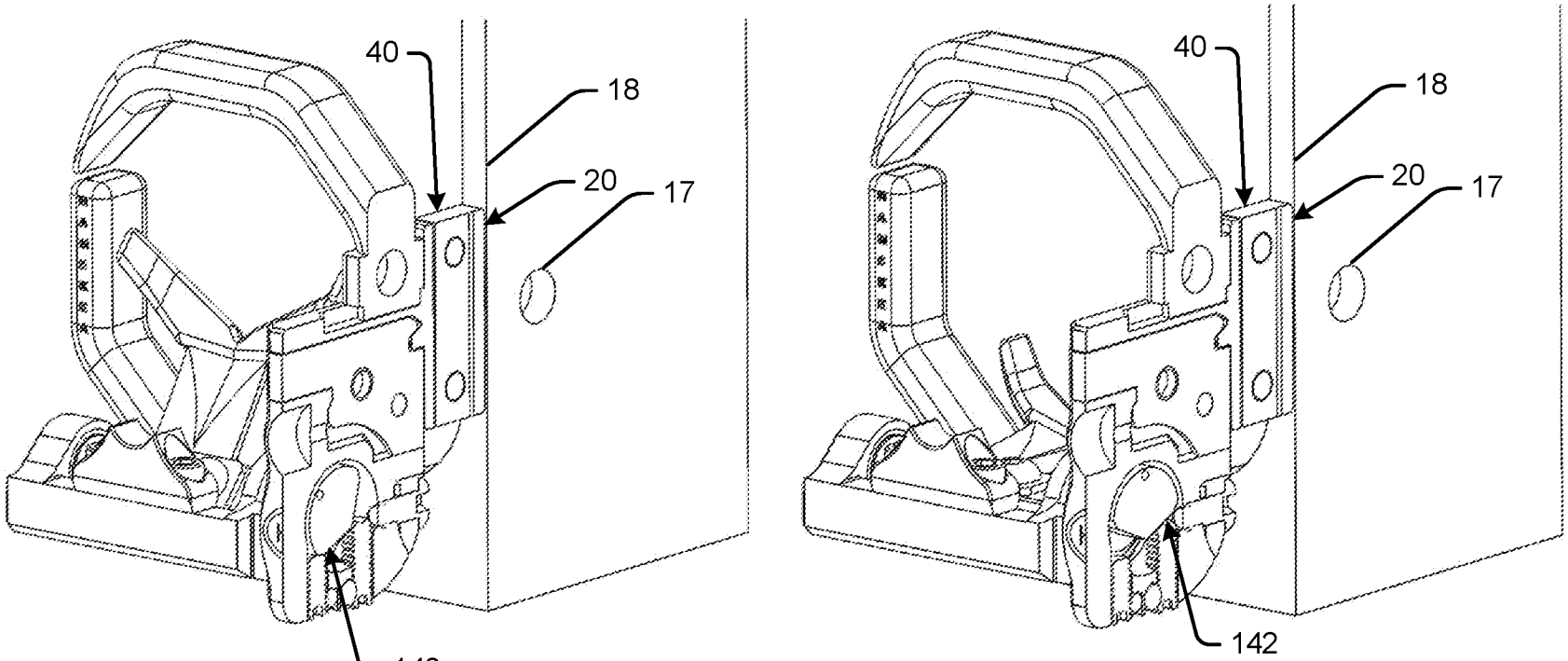
Figure 42:
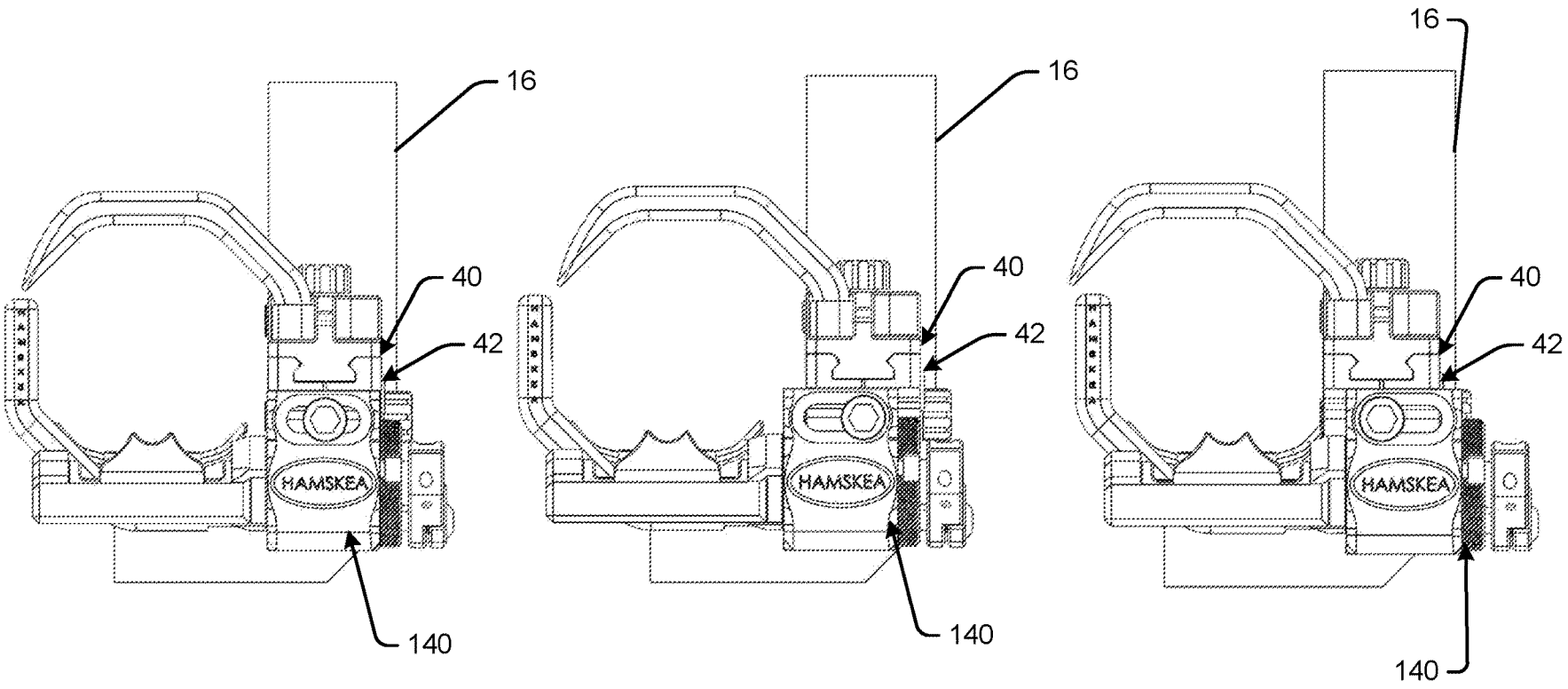
FIG. 42 illustrate lateral left/right adjustment positioning

FIGS. 41-42 illustrate shaft rotation. On the left side of FIG. 41, the shaft is shown rotated to the UP position so that the shaft surface and set screw interfere at 140. On the right side of FIG. 41, the shaft is rotated to the DOWN position, and the shaft surface and set screw interfere at 142. FIG. 42 shows the lateral position range of the accessory in the DOWN position relative to Datum A.

Figure 43:
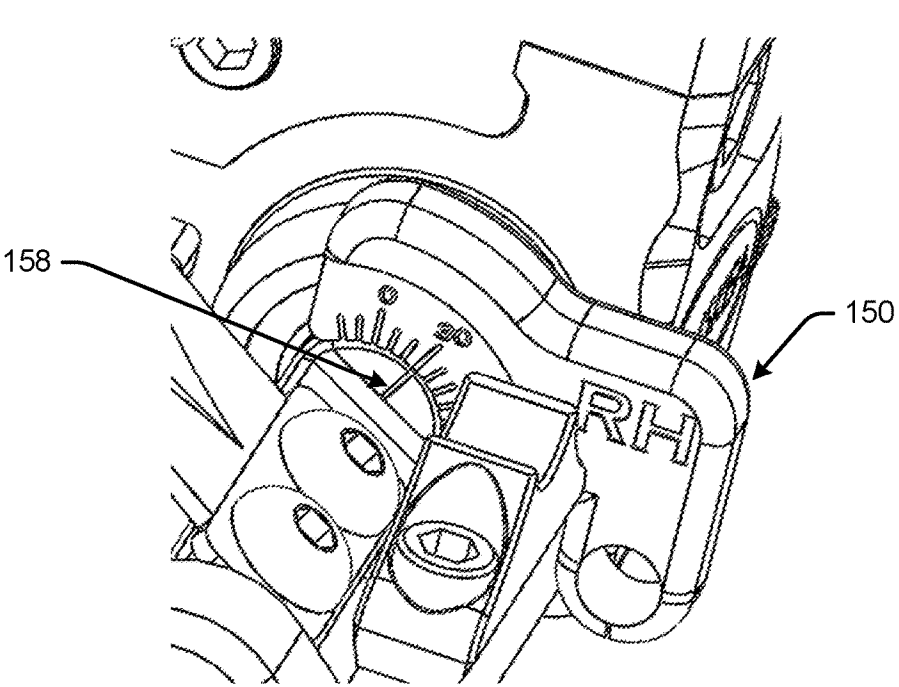
FIG. 43 illustrates angle reference indicators.
Figure 43:
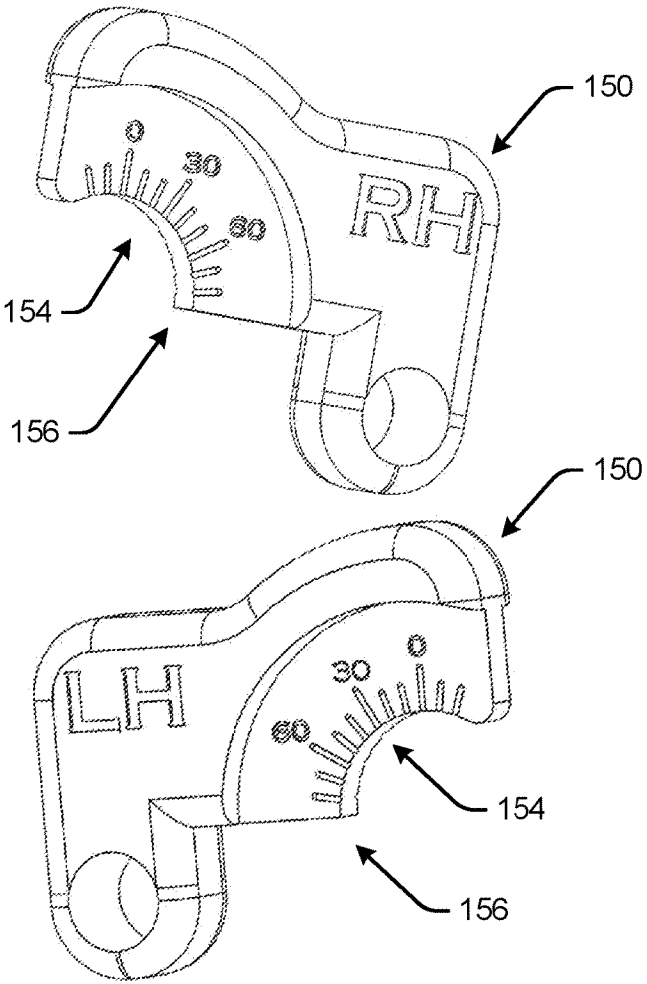

FIG. 43 illustrates ambidextrous launcher angle tools 150. The angle tools include numeric angle reference indicators 154 and mechanical coupling features that match the arrow rest body geometric features. The right hand tool 150 is shown attached on the arrow rest on the right side of FIG. 43, and is shown in the 30 degree position.

Figure 44:
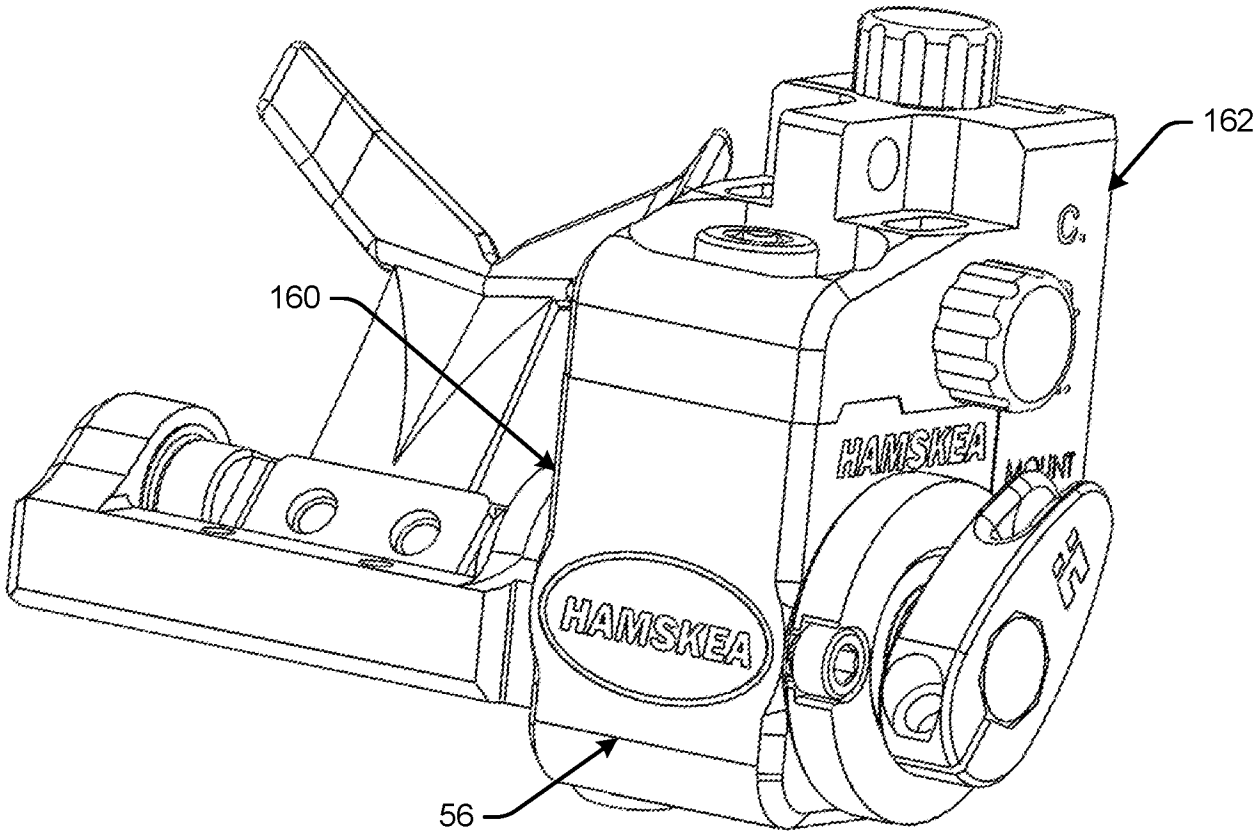
FIG. 44 illustrates an arrow rest assembly with polygon shaped mount T-shaped coupler and integrated accessory as part of the intermediate block.

FIG. 44 illustrates an arrow rest assembly 162 with intermediate block 160 with integrated accessory 56.

In use, the arrow rest is mounted to the polygon shaped mount 20 with a vertical base clamp member or coupler 40 having a perpendicular plank member 50. The clamp mechanism 40 and 41 has two opposing members with grooves on each inner surface. Where the clamping force is applied by a minimum of one threaded fasteners. The clamping force is applied to four (4) surfaces for the most stable and repeatable interface. Where the coupler 40 has an integral microtune adjustment mechanism coupled to the polygon shaped mount 20 with a peg-like element 82 (but not limited to). Where the peg-like element 82 couples the base of the coupler 40 to the polygon shaped mount 20 where the coupler 40 and the polygon shaped mount 20 move relative to each other. Where the peg 82 translates position linearly in a channel 88 of the base of the coupler through the rotation of the drive mechanism 80 coupled to the peg 82. The channel 88 limits the travel of the peg coupled to the polygon mount. The clamp system 41 has to be relieved when adjusting the vertical position of the rest with the microtune mechanism further described herein.

The perpendicular plank or rail member 50 has multiple alignment surfaces (planar or compound) 52 that are mostly parallel to the forward-aft axis 72*a* of the plank for coupling an intermediate block 42 that accommodates an accessory 45 (i.e. arrow rest, measurement tool, sight). Where the alignment surfaces 52 have two laterally disposed rail edges the main axis being substantially perpendicular to the coupler vertical base axis. The rail edges 52 protrude from a portion of the plank where they can be provided (but not necessary) a channel(s) for linear positioning of the intermediate block in the forward (i.e. toward the target) or aft (i.e. away from the target) directions. The adjacent alignment surfaces of the plank can be less than 90° relative to each other, forming channels described as dovetails or greater than or equal to 90° similar to the Picatinny rail standard.

A clamping mechanism 42, 43, with complementary plank protrusion geometry as one piece or multiple, as part of the intermediate block enables the force applied by a fastener or cam lock to linearly couple the intermediate block via a clamp mechanism to the protrusion surfaces of the plank, thereby securing the intermediate block's relative position along the length of the plank.

To provide for precise, repeatable and deterministic positioning of the intermediate block with respect to the plank 50, a protruding feature 44 either on the plank or the intermediate block 42 engages a cavity or channel(s) of the mating part to locate the two relative to each other. This limits the ability for the intermediate block to slide along the multiple alignment surfaces of the plank and allows for the intermediate block to be mounted perpendicular to the forward-aft axis of the plank. As a result the intermediate block cannot slide forward and/or aft the protruding surfaces of the plank are part of the clamping mechanism.

In another instance of precise, repeatable and deterministic positioning of the intermediate block 42 with respect to the plank 50, a minimum of one orthogonal channel 58 intersects with the protrusions of the plank edges 52 where the clamping force generated fastener shaft(s) intersect the orthogonal channels 58 of the plank edges and through the parallel surfaces 52. As the fastener couples to the complementary clamping mechanism of the intermediate block 42, this limits the ability for the intermediate block to slide along the multiple alignment surfaces 52 of the plank and allows for the intermediate block to be mounted perpendicular 72*b* to the forward-aft axis 72*a* of the plank.

A two-piece containment bracket 200 is integral to the arrow rest assembly where the top portion of the containment bracket is mounted to the coupler. Where the coupler has mechanical features 56 (but not limited to) to prevent the bracket from rotating. A mechanical feature or fastener is used to enable installation or removal of the top portion of the two-piece containment bracket 200*a*, 200*b*. Additional attachment/coupling mechanisms are also enabled by interference geometries between the containment brackets and features of the coupler.

The clamping force generated by clamp member 41 and fasteners 54*a* and 54*b* is distributed equally in either direction of the axis defined by the fasteners. Where two clamping forces are mostly centered about the clamping force device (e.g. threaded fastener 54*a*, 54*b*) where the clamp remains in an orthogonal position relative to the axis of the force applying device (fasteners 54*a* and 54*b*). Where the force applied by the device is mostly equal as applied to an angular planar surface of the polygon shaped mount 20 attached to the bow riser 16 and of the integral angular planar surface F1, F2, F3 of the coupler. Where the mostly parallel and equal forces F2 and F3 applied to each angular planar surface combined to equal the force applied to the opposite integral angular planar surface of the polygon shaped mount attached to the bow riser. Where in the fourth force F4 is orthogonal to the axis of the force device 54*a* and 54*b* to press the coupler protrusion 82 into the geometrically shaped mount 20 receiving feature 26 for a friction or interference fit.

The mechanical coupling for linear forward and aft movement between two components (coupler 40 and intermediate block 42) of an arrow rest involves multiple surfaces 52 that are collinear where the mating surfaces are parallel. The design disclosed herein relies on multiple parallel surfaces that are greater than or equal to 90 degrees relative to each other (e.g., a Picatinny rail system).

The relative position between the intermediate block 42 and the rest coupler 40 is controlled by a ball-detent feature 110 where the ball 108, spring 106 and spring compression device 106 are vertically housed in the rest coupler. The intermediate block 42 has a series of linear detent depression 110 that are in-line with the ball. As the two components move relative to each other as guided by the 90 degree co-linear surfaces 52 from one detent feature to the other, the ball is forced up against the spring and then is forced back down by the spring into the next detent feature. This allows for discrete and repeatable positioning for the optimum location.

The intermediate block 42 in one instance has a dovetail shape 74*a* that is orthogonal 72*b* to the forward-aft axis 72*a* of the plank 50. Where the dovetail shape 74*a* allows for interchangeability of the intermediate block as coupled to the carrier 70*b* where the carrier includes the accessory or the accessory 78 can be separate. This interchangeability allows for the ability to reconfigure the arrow rest assembly to optimize arrow position by exchanging the intermediate block coupled to the accessory 45 to accommodate the difference of arrow characteristics (e.g. diameter, spine or stiffness, length) on the same bow system 10. In all instances of the intermediate block, the microtune feature couples the block to the accessory, adjusting one relative to the other in a co-linear lateral orientation and the accessory is attached via a fastener through opening 60 where the complementary planar surfaces interface together through the clamping force of the threaded fastener through feature 60.

The ability to move the arrow rest linearly in the vertical, horizontal or forward/aft axes is key to long multiple geometric shaped interface (e.g., dovetail, Picatinny, hexagon, square, etc.) for tuning the final position of the arrow rest assembly and includes multiple co-linear surfaces. To do this a feature and function known as "microtune" relates to a mechanism that couples two of the arrow rest components (polygon shaped mount and coupler, coupler and intermediate block, intermediate block and accessory, etc.) as they move linearly relative to each other. There are many instantiations of these mechanisms. In the most common application, the microtune coupling peg 82 fits into a complementary shaped feature 26 (e.g., circle, ogive, polygon) of the mating component 20. The combination of the axial threaded drive mechanism coupled to the peg and the tolerance of the peg fitted in the receiving component creates "play" in the mechanism. This is experienced when reversing the rotation of the axial threaded drive mechanism 80 as the coupled components do not move immediately (i.e. backdrive) relative to one another.

To minimize the "play" in these types of mechanisms, eliminating both the mating thread tolerance between the axial drive 80 and the microtune peg 82 and the microtune peg 82 to the coupling feature 26 in the mount 20 or bow riser 87 is disclosed. By implementing a slot 86 in the threaded hole end 83 of the peg 82 allows the resulting tabs to be slightly non-parallel causing a binding force on the axial threaded drive mechanism 80, thereby eliminating the "play" of reversing the direction of the axial threaded drive 80.

On the opposite end of the microtune peg 82, eliminating the gap between the shape of the peg 82 and the coupling feature 26 is achieved by having small protruding features 84 from the outer surface of the peg 82 which effectively increases the effective circumference of the peg 82. When mated to the complimentary shape (blind hole 26 in the polygon shaped mount) of the mating arrow rest (e.g. the polygon shaped mount) the protruding features 84 yield by the mating force applied by fasteners 54*a* and 54*b* resulting in an interference fit between the two mating parts. This is achieved by but not limited to knurling, adding splines to the end of the microtune peg or an additional/separate component (over-sleeve, adhesive, etc.).

The combination of the aforementioned microtune feature and a coupler clamp interface requires the clamp to be separate components of the arrow rest assembly much like existing Picatinny rail systems. However, this interface is unique compared to a conventional Picatinny rail system in that the microtune peg couples the polygon shaped mount or channels integral to the bow riser and coupler for microtune linear adjustments. To couple the two elements together, the peg requires features to accommodate the rotational angle of the assembly geometry. To enable the coupling of the two elements, the base of the peg has to be significantly smaller than the diameter of the peg yet provides an interference fit described previously. This feature of the peg can be linear (i.e. chamfer, wedge, plane intersecting chamfer 85) or as round (i.e. conic, round, spherical).

This microtune-ability and associated coupler and peg apply to, the adjustments for lateral, vertical and forward and aft movement of the arrow rest relative to the bow riser. Forward and aft implementation not shown.

To secure the T-shaped coupler 40 to the Intermediate block 42 relative to each other, one or more mating co-linear surfaces 52 between the two components are forced together via a threaded fastener where the applied force between the two components cannot be overcome. The design disclosed herein represents one of several approaches for achieving this condition.

To secure the rest coupler 40 to the mount 20 relative to each other, one or more mating co-linear surfaces between the two components are forced together via a threaded fastener 52*a* and 5*b* where the applied force between the two components cannot be overcome. The mating force generated by the threaded fastener yields the protruding features 84 of the microtune peg 82 resulting in an interference fit between the two mating features of each part. The design disclosed herein represents one of several approaches for achieving this condition.

A fastener provides the locking force between the two components. Where the locking force that secures the intermediate block in the specific position is generate in one of several ways to include a pinching force or clamping force previously describe (i.e. Picatinny).

Where the intermediate block 42 contains a protrusion 44 that engages a complementary feature 58 that is wider than the protrusion enabling the accessory to move laterally, limited by the interference of the intermediate block protrusion and the slot of the accessory.

The accessory has all the features for a limb actuated configured arrow rest. These include a torsion spring that transfers torque between the housing coupled through the spring to the shaft 120. Attached to the shaft 126 is the compound angled arrow launcher 134. The shaft rotates to lift the launcher, thereby lifting the arrow into launch position. At one end of the shaft is a polygon shape 122 (e.g., octagon, hexagon, semi-circle, etc.) to which a lever arm 93 with the same geometric shape is coupled with a clamping force administered by a threaded fastener not shown). Attached to the lever arm is the cord 94 that provides the mechanism that translates the force of the limb to the lever arm, thereby rotating the shaft and arrow launcher down and out of the way of the launched arrow.

The lever arm 93 is a two piece design that captures the cord 94 with a clamping force applied by a threaded fastener 96 to the clamp 95. Where the clamp 95 slides over a protrusion 97 of the lever arm 93. This allows the clamp 95 to slide along the protrusion 97 axis and applies the clamping force where the surface of the clamp and the surface of the lever arm 93 are parallel. The asymmetric feature(s) of the clamp and complementary feature of the lever arm prevent the clamp from rotating as the clamping force is applied. This allows for easy and quick adjustment of the cord to optimize the length. This feature on the lever arm 93 eliminates the need for a conventional cord clamp 99 that is independent of the lever arm that is used for this adjustment or the need for a quick cord length adjustment device, as in U.S. Pat. No. 10,852,097.

An arrow rest that has a rotating shaft 120 requires the ability to position the launcher coupled to the rotating shaft relative to an optimum arrow position related to the geometric features of the bow system. Repeatability is paramount for accuracy in that that rotation position has to be set, stable and known. The design disclosed herein makes use of compound lateral features 124 as part of the rotating shaft that provide a contact surface 124 for a physical stop 120*a* and 120*b* and known angular offset relative to the receiving feature of the shaft and arrow launcher. These compound lateral surfaces 124 on the rotating shaft and the vertical positioning mechanisms 120*a* and 120*b* work together to position the shaft in angular space for both the UP and DOWN positions. The ability to adjust these positions enables fine tunability for eliminating interference with the arrow and its steering devices and to optimize the launcher angle for accuracy. In the body of the rest there are vertically adjustable mechanisms (headless screws) 120*a* and 120*b* for changing the location of where the horizontal rotating shaft feature 124 intersects with the vertical adjustment mechanism. As the vertical adjustment mechanism changes position, the contact/interference position 140 and 142 between these two components changes in the rotational domain. To ensure the vertical adjustment mechanism does not move for repeatability and accuracy, a horizontal locking mechanism (set screw not shown) imparts a locking force against the vertical mechanism. Access to the horizontal locking device is made through the components of the arrow rest assembly (body and spring knob) 129.

In addition to this approach, these vertical position mechanisms 120*a* and 120*b* are held in place by spherical locking devices 128*a* and 128*b* that are malleable. When the mechanism intersects the locking spheres 120*a* and 120*b*, the spheres yield in the shape of the vertical mechanisms, thereby creating a resistive force which prevents the vertical mechanism from changing position or becoming loose.

A common practice for identifying the launcher angle rotational position includes scribe or etchings/laser marks that are applied to the shaft 120 and the accessory 45. In some cases the geometry of the arrow rest components (shaft, body, and intermediate block) prevent these markings from being realized. A separate rotational angle positioning device enables the angular position of the rotating shaft and coupled arrow launcher to be set and known. The positioning device 150 translates arrow rest component internal and/or external geometry features (surface 156, edges, corners, holes, curves 154, circles, polygon shapes) to shaft angular position. To translate arrow rest component features through the angle indicator device, the rotating shaft includes a reference mark 158 which in this case is a vertical line that is normal to the launcher mounting surface when in the DOWN or zero degree position.

An example mounting bracket assembly may include, but is not limited to, a vertical dovetail bracket 20 and a side mount bracket 37. This attaches to the side of the bow riser 16 via the Berger hole 17 which is an AMO standard mount/interface.

The L-shaped bracket 37 is unique in its ability to locate the polygon shaped bracket 20 laterally to position the rest assembly at discrete lateral intervals 31, 32 and 33. It is critical to locate the arrow rest assembly and the arrow rest launcher at the centershot of the bow systems which is typically about 13/16 inch to about ¾ inch from the inside vertical surface of the bow riser. The reason for this implementation is that bracket assembly references the arrow rest assembly to the outside vertical surface of the bow riser, unlike the polygon shaped mount 20 being attached directly to the aft surface 18 of the bow riser 16. Bow risers vary in thickness between about 0.50 and about 1.0 inches. The ability to position the vertical dovetail mount laterally behind (full or partial) the bow riser enables the arrow rest assembly (i.e. center of the arrow rest launcher) to be positioned at or very near the center shot of the bow system. By doing so, the additional lateral adjustment can be made by the arrow rest to micro-tune the final position for the optimum centershot location.

It is critical to have the vertical polygon shaped mount 20 positioned vertically to enable the arrow rest assembly to be adjusted for the optimum vertical position. The vertical axis of the geometrically shaped mount 20 is defined by the two mounting holes 24 of the riser to which the mount 20 is attached and the vertical plane is defined to intersect with the target surface plane. This plane is substantially parallel to the inward (i.e. Left, aft looking forward) or outward (i.e. right, aft looking forward) vertical surfaces of the bow riser's 16 main grip assembly. If the mount 20 vertical plane is not substantially parallel to the bow riser inward and outward riser vertical surfaces, then as the rest assembly moves up and down, the rest assembly moves left-to-right or vice versa. The mounting bracket assembly 30 is a two-piece design where the mating features of the vertical polygon shaped mount 20 and side mount bracket align the polygon shaped mount substantially parallel to the inward or outward vertical surfaces of the bow riser's main grip assembly. The receiving and complementary mating features 35*a* and 35*b* between the side mount bracket 30 and the polygon shaped mount 20 alignment features 25*a* and 25*b* allow for the vertical translation while simultaneously allowing for the differences in the bow riser thickness for optimum center shot location of the arrow rest.

It is obvious for those skilled in the art that there are additional embodiments that are the reverse orientation or configuration of the invention disclosed herein. That being, the mechanism with coupling protrusion 82 could be embodied on the geometrically shaped mount 20 with the movable protrusion 82 being pressed into the coupler 40 for instance as one example.

The examples shown and described herein disclose an implementation of an L-shaped mounting bracket 37. It is noted that other implementations include a straight mounting bracket (i.e. not L-shaped) with aligning features for those skilled in the art.

The examples shown and described herein disclose the L-shaped brackets 37 with through holes 36 and the threaded receiving interface being implemented in the dovetail bracket. It is noted that other implementations include the reverse orientation where the through hole for the fastener is implemented in the polygon shaped mount 20 and the threaded receiving interface is implemented in the mounting bracket 30 (L-shape or straight), where the through hole 24 has a chamfer feature to receive a flathead screw to center the dovetail bracket to the threaded hole, thereby vertically aligning the dovetail mount substantially vertical to the bow riser 16 vertical inward and outward surfaces.

In a first example embodiment, Applicant discloses a substantially T-shaped Picatinny mount that has a base and a plank member that is perpendicular to the base with an integral microtune coupling feature to the polygon shaped mount. The base has a parallel clamping system made up of two pieces. The clamping system shape is complementary to the polygon shaped mount that enables the t-shape coupler to mount and move relative to the polygon shaped mount. The polygon shaped mount is attached to any side of a weapon (e.g., archery bow handle, firearm). The two-piece clamp design enables the mounting of the T-shaped Picatinny mount in conjunction with the microtune feature. The microtune feature has an integral drive mechanism where an element of the microtune drive feature has a protrusion (e.g. a peg) that couples the T-shaped coupler to the polygon shaped mount. The microtune drive features allow small incremental relative position changes between the two members. The coupling protrusion has a feature that enables the T-shaped mount to be coupled to the polygon shaped mount. Unlike other approaches this design allows the T-shaped mount to be rotated (angle lambda, FIG. 28), into position which requires the coupling protrusion or peg to be smaller or chamfered at the engagement end of the peg. By doing so, the T-shaped coupler with two-piece clamp and integral microtune mechanism with protrusion does not have to be disassembled or dismantled to be coupled to the receiving geometrically shaped mount 20.

In a second example embodiment, Applicant discloses an intermediate block adaptable to the T-shaped coupler by a clamp mechanism. The intermediate block has an integral protrusion feature (boss, shoulder, etc.) that couples to a complementary feature of the T-shaped coupler and prevents the intermediate block from slidably changing position along the plank axis of the T-shaped coupler. The intermediate block may include an integral accessory. The intermediate block enables the coupling of an accessory where an integral extrusion boss feature of the intermediate block limits the lateral travel. The relative lateral position between the intermediate block and accessory are secured by a fastener.

In a third example embodiment, Applicant discloses a two-piece intermediate block that allows the coupled accessory to be interchanged without changing the position of the portion of the intermediate block secured the plank portion of the T-shaped coupler. This allows for the precise and repeatable interchangeability of the accessory.

In a fourth example embodiment, Applicant discloses a two piece lever arm that allows for easy cord length adjustment where the cord is secured by a non-binding clamping for applied between a non-rotating member. The boss feature eliminates the fraying of the cord which extends its useful life.

In a fifth example embodiment, Applicant discloses a two piece bracket that allows for the lateral positioning of a polygon shaped mounting bracket. The polygon shaped mounting bracket has several vertical surfaces to receive a clamping mechanism associated with an accessory assembly.

It is noted that the examples shown and described are provided for purposes of illustration and are not intended to be limiting. Still other examples are also contemplated.

The invention claimed is:

1. An arrow rest device for an archery bow, comprising:

a mounting bracket for connecting an archery accessory on a bow riser of the archery bow;

a receiving feature formed as an opening in the mounting bracket for the archery accessory;

a coupler mount for rotatably coupling onto the mounting bracket for the archery accessory;

a peg attached on a first end portion to the coupler mount, the peg engaging with the receiving feature, in a first direction as the coupler mount is rotated in the first direction, and the peg engaging with the receiving feature in a second direction as the coupler mount is rotated in the second direction opposite to the first direction;

a second end portion of the peg configured to slide into the receiving feature as the coupler mount is rotated in the first direction; and a chamfered surface of the second end portion of the peg configured to self-align the peg in the receiving feature, the chamfered surface forming a variable cross-section of the second end portion of the peg, wherein the variable cross-section of the peg is defined as having a circular shape prior to the chamfered surface and a partial circular shape with a chord along the chamfered surface, a length of the chord having a variable length from small to large and back to small as a resultant arc of the circumference continues to decrease.

2. The arrow rest device of claim 1, wherein the mounting bracket has a substantially T-shaped cross section and the coupler mount has a portion with a mating cross-section.

3. The arrow rest device of claim 1, further comprising a threaded drive mechanism for the peg to move the coupler mount relative to the mounting bracket when the threaded drive mechanism is activated.

4. The arrow rest device of claim 3, wherein the peg is mounted to the threaded drive mechanism.

5. The arrow rest device of claim 4, wherein the threaded drive mechanism has a threaded axial member with a knob to rotate the threaded axial member for moving the peg linearly along a threaded drive axis.

6. An arrow rest device for an archery bow, comprising:

a mounting bracket for connecting an archery accessory on a bow riser of the archery bow;

a receiving feature formed as an opening in the mounting bracket for the archery accessory;

a coupler mount for rotatably coupling onto the mounting bracket for the archery accessory;

a peg having a head portion attached to the coupler mount, the peg engaging with the receiving feature, in a first direction as the coupler mount is rotated in the first direction, and the peg engaging with the receiving feature in a second direction as the coupler mount is rotated in the second direction opposite to the first direction;

a base portion of the peg configured to slide into the receiving feature as the coupler mount is rotated in the first direction; and a chamfered surface of the base portion of the peg configured to self-align the peg in the receiving feature, the chamfered surface forming a variable cross-section of the second end portion of the peg, wherein the variable cross-section of the peg is defined as having a circular shape prior to the chamfered surface and a partial circular shape with a chord along the chamfered surface, a length of the chord having a variable length from small to large and back to small as a resultant arc of the circumference continues to decrease.

7. The arrow rest device of claim 6, further comprising a threaded drive mechanism.

8. The arrow rest device of claim 7, wherein the threaded drive mechanism is operable to move the coupler mount relative to the mounting bracket when the peg is coupled to the receiving features in the mounting bracket.

9. The arrow rest device of claim 8, wherein the threaded drive mechanism has a threaded axial member, a knob and a channel, and wherein the peg is mounted to the threaded drive mechanism and the knob moves the peg linearly along a threaded drive axis.

10. The arrow rest device of claim 9, wherein the peg moves linearly in the channel when the knob is rotated.

11. An arrow rest device for an archery bow, comprising:

a mounting bracket for connecting an archery accessory on a bow riser of the archery bow;

a receiving feature formed as an opening in the mounting bracket for the archery accessory;

a coupler mount for coupling onto the mounting bracket for the archery accessory;

a peg engaging with the receiving feature as the coupler mount is coupled to the mounting bracket, and a plurality of protruding features on at least a portion of an outer surface of the peg, the protruding features yielding during inserting into the receiving feature resulting in an interference fit reducing a gap between the outer surface of the peg and the opening in the receiving feature of the mounting bracket for the archery accessory when the peg is inserted in the opening in the receiving feature of the mounting bracket for the archery accessory; and a chamfered surface self-aligning the peg in the receiving feature, the chamfered surface having a circular cross-section of the peg before the chamfered surface and a partial circular cross-section and chord shape along a length of the chamfered surface, wherein a length of the chord changes from small to large and back to small as a resultant arc of the circumference section continues to decrease as the peg moves into the receiving feature.

12. The arrow rest device of claim 11, wherein the plurality of protruding features are splines.

13. The arrow rest device of claim 12, wherein the plurality of protruding features are formed by knurling.

14. The arrow rest device of claim 11, further comprising a threaded drive mechanism operable to move the coupler mount relative to the mounting bracket, wherein the threaded drive mechanism has a threaded axial member, a knob and a channel, and wherein the peg is mounted to the threaded drive mechanism and the knob rotates the threaded axial member.

15. The arrow rest device of claim 11, wherein the peg has a slot.

16. The arrow rest device of claim 14, wherein the chamfered surface of the peg is configured to self-align the peg in the receiving feature, the chamfered surface forming a variable cross-section of an end portion of the peg, wherein the variable cross-section of the peg is defined as having a circular shape prior to the chamfered surface and a partial circular shape with a chord along the chamfered surface, a length of the chord having a variable length from small to large and back to small as a resultant arc of the circumference continues to decrease.

* * * * *